US008994294B2

(12) United States Patent
Sawada et al.

(10) Patent No.: US 8,994,294 B2
(45) Date of Patent: Mar. 31, 2015

(54) LED FLASH MODULE, LED MODULE, AND IMAGING DEVICE

(71) Applicant: Rohm Co., Ltd., Kyoto (JP)

(72) Inventors: Hideki Sawada, Kyoto (JP); Kazuyuki Hiratsuka, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 124 days.

(21) Appl. No.: 13/737,938

(22) Filed: Jan. 9, 2013

(65) Prior Publication Data

US 2013/0207566 A1 Aug. 15, 2013

(30) Foreign Application Priority Data

Jan. 10, 2012 (JP) ..... 2012-02073
Mar. 1, 2012 (JP) ..... 2012-45030

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 33/08*** | (2006.01) |

(52) U.S. Cl.

CPC ..... *H05B 33/0833* (2013.01); *H05B 33/0815* (2013.01); *H05B 33/0827* (2013.01); *H05B 33/0857* (2013.01)

USPC ..... 315/312; 315/187; 315/192; 315/318

(58) Field of Classification Search

None

See application file for complete search history.

(56) References Cited

U.S. PATENT DOCUMENTS

| | | | | |
|---|---|---|---|---|
| 8,018,151 | B2 * | 9/2011 | Chung et al. | 313/506 |
| 2011/0260646 | A1 * | 10/2011 | Moon et al. | 315/294 |
| 2012/0306410 | A1 * | 12/2012 | Kono et al. | 315/362 |

FOREIGN PATENT DOCUMENTS

JP 2003-215670 A 7/2003

* cited by examiner

*Primary Examiner* — Anh Tran

(74) *Attorney, Agent, or Firm* — Rabin & Berdo, P.C.

(57) ABSTRACT

An LED flash module includes: a module substrate; an energy device disposed on the module substrate; an LED module arranged on the module substrate includes a plurality of LED blocks arranged in a first direction, each LED block including a plurality of LED elements which is arranged in a second direction perpendicular to the first direction and emits light with power supplied from the energy device; a charger circuit arranged on the module substrate to charge the energy device; and a control circuit arranged on the module substrate to control emission of LED elements. A wiring length from one of the LED elements to a plus terminal of a power supply portion supplying power to each of the LED elements and a wiring length from the one of the LED elements to a minus terminal of the power supply portion is substantially the same for all of the LED elements.

24 Claims, 45 Drawing Sheets

LED FLASH MODULE, LED MODULE, AND IMAGING DEVICE

CROSS-REFERENCE TO RELATED APPLICATIONS

This application is based upon and claims the benefit of priority from Japanese Patent Application Nos. 2012-002073, filed on Jan. 10, 2012, and 2012-045030, filed on Mar. 1, 2012, the entire contents of which are incorporated herein by reference.

TECHNICAL FIELD

The present disclosure relates to an LED flash module, an LED module and an imaging device, and more particularly relates to an LED flash module, an LED module and an imaging device, which are capable of reducing time required for charging with a low voltage operation and achieving compactness and lightness.

BACKGROUND

There have been conventional digital cameras and monitoring cameras incorporating a flash device. A xenon lamp is mainly used as a light source for the flash device because of its short time large light output and high color rendition.

As shown in FIG. 43, such a flash device includes a xenon lamp 401, an inverter 402, an aluminum electrolytic condenser 403, a switch circuit 404 and so on. Electric charges charged in the aluminum electrolytic condenser 402 are converted into a current by a switching operation using the inverter 402 in order to emit light from the xenon lamp 401.

However, it takes time for such a conventional flash device to charge the aluminum electrolytic condenser 403 once light is emitted, which may result in difficulty in continuous emission and impossibility to achieve continuous lighting.

In addition, such a conventional flash devices using the xenon lamp 401 require plastic protection against high voltages and is hard to achieve compactness or lightness due to its large volume.

SUMMARY

The present disclosure provides some embodiments of an LED flash module, an LED module and an imaging device, which are capable of reducing the time required for charging using a low voltage operation and achieving compactness and lightness.

According to some embodiments, there is provided an LED flash module including: a module substrate; an energy device which is disposed on the module substrate, having a laminated body of two or more layers including positive and negative active material electrodes and positive and negative lead-out electrodes, which are integrally formed, and a separator interposed between the positive and negative active material electrodes and configured to pass electrolytes and ions, the two or more layers being laminated such that the lead-out electrodes are exposed from the positive and negative active material electrodes and the active positive and negative material electrodes are alternated; an LED module arranged on the module substrate and including a plurality of LED blocks arranged in a first direction, each LED block including a plurality of LED elements which are arranged in a second direction perpendicular to the first direction and which emit light with power supplied from the energy device; a charger circuit which is arranged on the module substrate and charges the energy device; and a control circuit arranged on the module substrate and configured to control emission of the LED elements, wherein a wiring length from one of the LED elements to a plus terminal of a power supply portion supplying power to the LED elements and a wiring length from the one of the LED elements to a minus terminal of the power supply portion is substantially same for all LED elements.

According to some other embodiments, there is provided an LED module including a plurality of LED blocks arranged in a first direction, each LED block including a plurality of LED elements arranged in a second direction perpendicular to the first direction, wherein a wiring length from one of the LED elements to a plus terminal of a power supply portion supplying power to the LED elements and a wiring length from the one of the LED elements to a minus terminal of the power supply portion is substantially same for all LED elements.

According to some other embodiments, there is provided an imaging device including the above-described LED flash module.

DETAILED DESCRIPTION

Figure 1A:
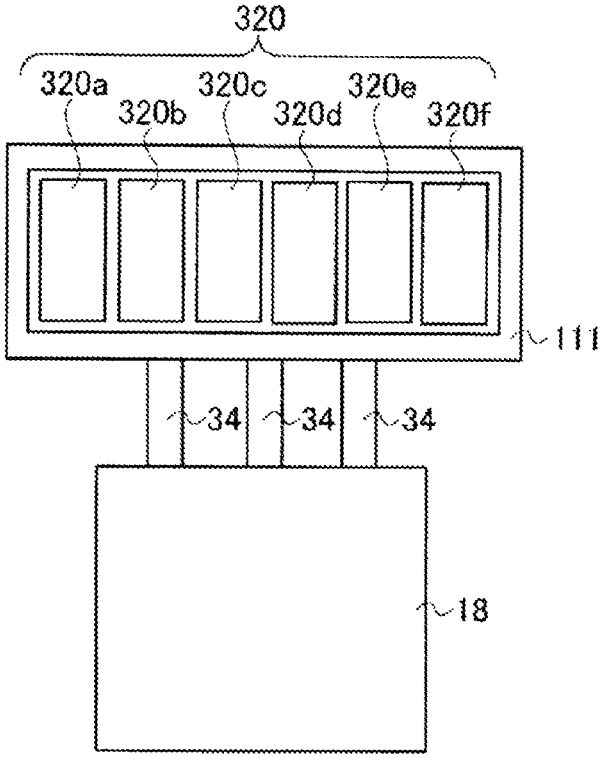
FIG. 1A is a schematic plan view of an LED flash module according to a first embodiment, when viewed from a front surface of the LED flash module.

Reference will now be made in detail to various embodiments, examples of which are illustrated in the accompanying drawings. In the following detailed description, numerous specific details are set forth in order to provide a thorough understanding of the present invention(s). However, it will be apparent to one of ordinary skill in the art that the present invention(s) may be practiced without these specific details. In other instances, well-known methods, procedures, systems, and components have not been described in detail so as not to unnecessarily obscure aspects of the various embodiments.

Embodiments of the present disclosure will hereinafter be described with reference to the drawings. In the drawings, the same or similar elements are denoted by the same or similar reference numerals. It is however noted that figures in the drawings are just schematic and a relationship between thickness and dimension of elements, a thickness ratio of layers and so on may be drawn opposed to the reality. Therefore, details of the thickness and dimension should be determined based on the following detailed description. In addition, it is to be understood that different figures in the drawings may have different dimension relationships and ratios.

The following embodiments provide devices and methods to embody the technical ideas of the present disclosure and material, shape, structure, arrangement and so on of elements in the disclosed embodiments are not limited to those specified in the following description. Various modifications to the embodiments of the present disclosure may be made without departing from the spirit and scope of the present disclosure which are defined by the claims.

First Embodiment

A first embodiment of the present disclosure will now be described in detail with reference to FIGS. 1A to 8B.

(Configuration of LED Flash Module)

Figure 1B:
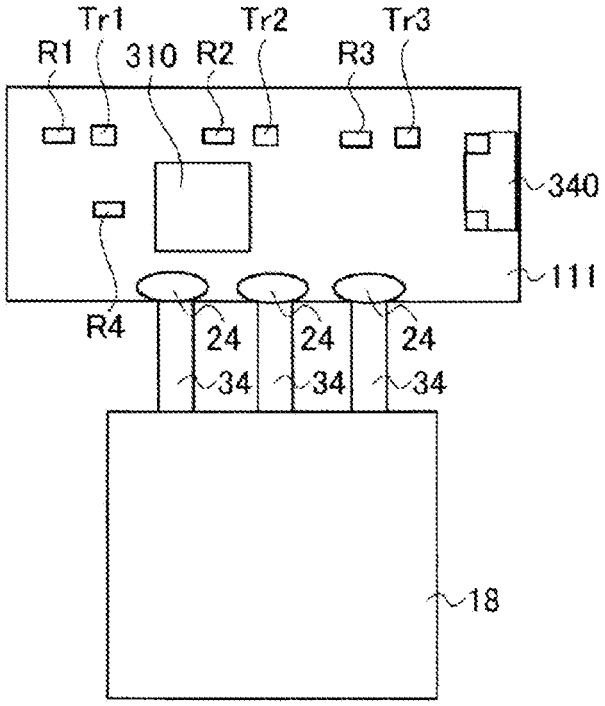
FIG. 1B is a schematic plan view of the LED flash module according to the first embodiment, when viewed from a rear surface of the LED flash module.
Figure 2:
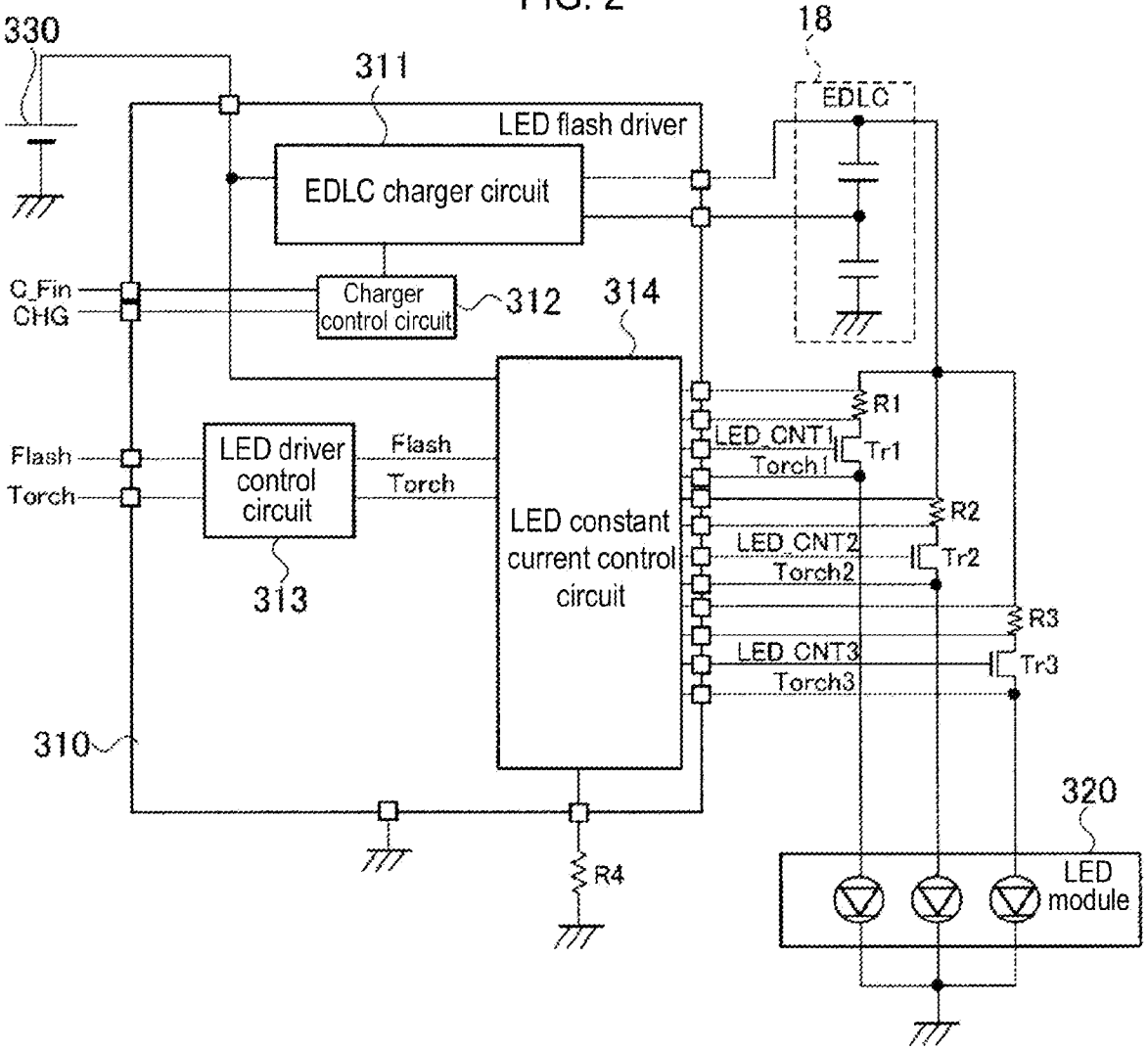
FIG. 2 is a schematic circuit block diagram of the LED flash module according to the first embodiment.
Figure 3A:
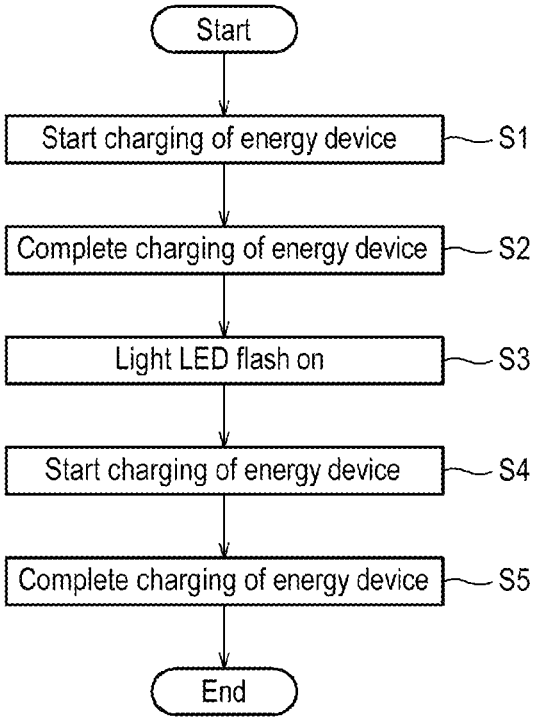
FIG. 3A is a flow chart for illustrating an operation of an energy device at the time of charging in the LED flash module according to the first embodiment.
Figure 3B:
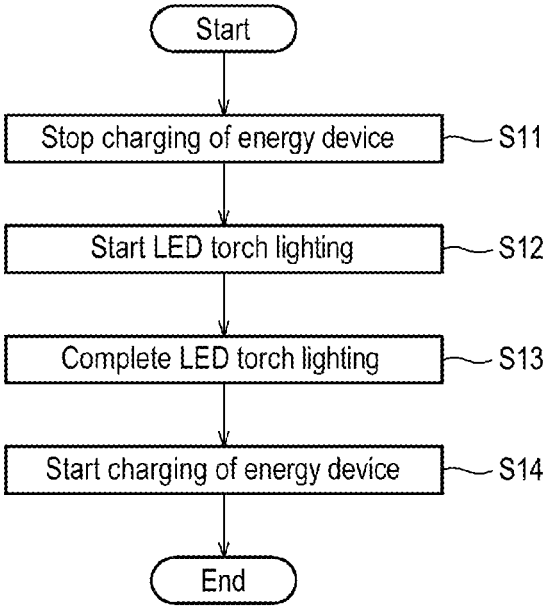
FIG. 3B is a flow chart for illustrating an operation in an LED torch mode in the LED flash module according to the first embodiment.

An LED flash module according to a first embodiment, as shown in FIGS. 1A, 1B and 2, includes a module substrate 111; an energy device (for example, EDLC (Electric Double Layer Capacitor)) 18 which is disposed on the module substrate 111 and has a laminated body of two or more layers including positive and negative active material electrodes and positive and negative lead-out electrodes 34, which are integrally formed, and a separator 30 (see FIGS. 40 to 42) which is interposed between the positive and negative active material electrodes and passes electrolytes and ions, the two or more layers being laminated such that the lead-out electrodes 34 are exposed from the positive and negative active material electrodes and the positive and negative active material electrodes are alternated; an LED module 320 which is arranged on the module substrate 111 and includes a plurality of LED blocks 320*a* to 320*f* arranged in a first direction (for example, a horizontal direction), each LED block including a plurality of LED elements which is arranged in a second direction (for example, a vertical direction) perpendicular to the first direction and emits light with power supplied from the energy device 18; an EDLC charger circuit 311 which is arranged on the module substrate 111 and charges the energy device 18; and an LED driver control circuit 313 which is arranged on the module substrate 111 and controls emission of the LED elements, wherein a wiring length from one of the LED elements to a plus terminal 321 of a power supply portion supplying power to the LED elements and a wiring length from the one of the LED elements to a minus terminal 322 of the power supply portion is substantially the same for all LED elements.

Figure 4A:
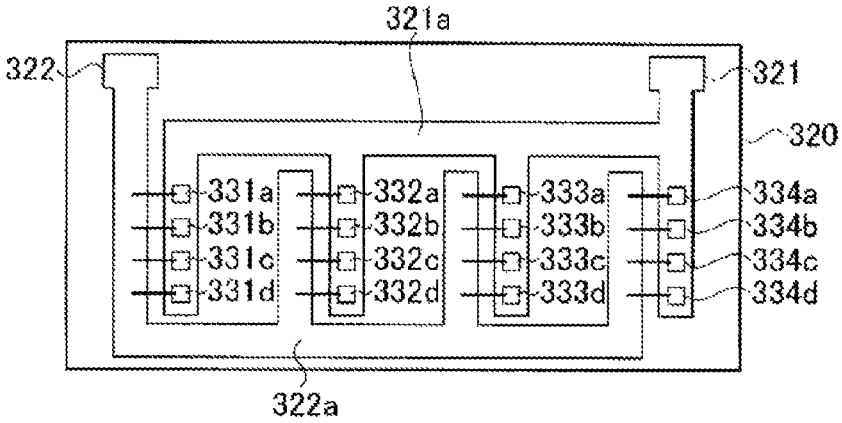
FIG. 4A is a schematic plan view of an LED module according to the first embodiment for illustrating a configuration of an LED block.
Figure 4B:
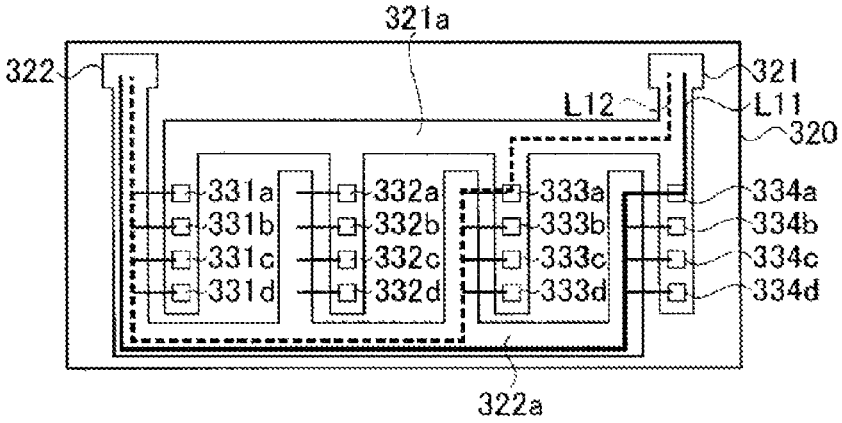
FIG. 4B is a schematic plan view of the LED module according to the first embodiment for illustrating a wiring length.

Each of the LED blocks 320*a* to 320*f* may include, as shown in FIGS. 4A and 4B, comb-like wiring patterns 321*a* and 322*a*, which may be disposed in an interdigital relationship with each other.

The LED module 320 may be mounted on a front surface of the module substrate 111 and the charger circuit 311 and the LED driver control circuit 313 may be mounted on a rear surface of the module substrate 111.

The LED driver control circuit 313 may selectively illuminate desired ones of the plurality of LED elements.

More specifically, FIGS. 1A and 1B are schematic plan views of an LED flash module according to a first embodiment, when viewed from a front surface and a rear surface of the LED flash module, respectively. As shown in FIG. 1A, an LED module 320 is mounted on a front surface of a module substrate 111. The LED module 320 includes 6 LED blocks 320*a* to 320*f* arranged in a horizontal direction. Each of the LED blocks 320*a* to 320*f* includes a plurality of LED elements arranged in a vertical direction, details of which will be described later. Although the LED module 320 includes 6 LED blocks 320*a* to 320*f*, it is to be understood that the number of LED blocks is not particularly limited but may be, for example, 7 or more. As shown in FIG. 1B, on a rear surface of the module substrate 111 are mounted an LED flash driver 310, external attachment transistors Tr1 to Tr3, external attachment resistors R1 to R3, a connector 340 and other components. In addition, lead-out electrodes 34 are welded to solder connections 24 of the module substrate 111. An energy device 18 is a laminated energy device such as, for example, EDLC (Electric Double Layer Capacitor) or the like. The EDLC accumulates electric charges using an electric double layer formed at an interface between an electrode and electrolytes, thereby providing higher endurance against rapid charging/discharging than secondary batteries using a chemical reaction.

FIG. 2 is a schematic block diagram of the LED flash module according to the first embodiment. As shown in FIG. 2, the LED flash driver 310 includes an EDLC charger circuit 311, a charger control circuit 312, an LED driver control circuit 313 and an LED constant current control circuit 314. The EDLC charger circuit 311 charges the energy device 18 with power supplied from a battery 330. The charger control circuit 312 controls the EDLC charger circuit 311 based on a CHG signal or a C_Fin signal. The LED driver control circuit 313 controls emission of a plurality of LED elements based on a Flash signal or a Torch signal. Desired ones of the plurality of LED elements can be selectively turned on/off in the respective LED block. The LED constant current control circuit 314 drives the LED module 320 with power supplied from the battery 330.

(Operation of LED Flash Module)

First, an operation of the energy device 18 at the time of charging will be described. The EDLC charger circuit 311 in the LED flash driver 310 charges the energy device 18 with the power supplied from the battery 330 (Steps S1 and S4 in FIG. 3A). The CHG signal and the C_Fin signal are input to the charger control circuit 312. When the CHG signal is input to the charger control circuit 312, the charger control circuit 312 switches between charge ON and OFF. When the charging of the energy device 18 is completed (Steps S2 and S5 in FIG. 3A), a flag is output from the C_Fin signal. When the energy device 18 is under a charging operation, the LED module 320 emits no light.

An operation in an LED flash mode will be described next. When the Flash signal is input with the charging completion state of the energy device 18, the external attachment transistors Tr1 to Tr3 are turned on by LED_CNT1 to LED_CNT3 signals, respectively, to cause current to flow into the LED module 320, thereby lighting the LED flash on (Step S3 in FIG. 3A). At this time, the energy device 18 is put into a charging OFF state by the CHG signal. The current in the LED flash mode is adjusted by the external attachment resistors R1 to R3.

An operation of an LED torch mode will be described next. The LED constant current control circuit 314 in the LED flash driver 310 drives the LED module 320 with power supplied from the battery 330 (Step S12 in FIG. 3B). At this time, the external attachment transistors Tr1 to Tr3 are put into an OFF state by the LED_CNT1 to LED_CNT3 signals, respectively. The current in the LED torch mode is adjusted by an external attachment resistor R4. Lighting the LED torch on during the charging operation of the energy device 18 may be avoided as it may make a voltage of the battery 330 too low. Accordingly, the charging of the EDLC may be stopped before start of the LED torch lighting (Steps S11 and S12 in FIG. 3B) and may be restarted after end of the LED torch lighting (Steps S13 and S14 in FIG. 3B).

(Configuration of LED Module)

As shown in FIG. 4A, the LED module 320 according to the first embodiment includes a plurality of LED blocks arranged horizontally, each block including a plurality of LED elements arranged vertically. It is here assumed that each group of LED elements 331*a* to 331*d*, 332*a* to 332*d*, 333*a* to 333*d* and 334*a* to 334*d* forms one LED block. The LED module 320 employs a COB (Chip On Board) structure in which a bear chip (LED elements themselves) is directly mounted on wiring patterns on a module substrate, wire-bonded and sealed by resin.

In addition, as shown in FIG. 4A, the LED module 320 according to the first embodiment includes a comb-like first wiring pattern 321*a* and a comb-like second wiring pattern 322*a* and the LED elements 331*a* to 331*d*, 332*a* to 332*d*, 333*a* to 333*d* and 334*a* to 334*d* are mounted on the first wiring pattern 321*a* and are wire-bonded to the second wiring pattern 322*a*.

As shown in FIG. 4A, the comb-like wiring pattern 321*a* and the comb-like wiring pattern 322*a* are disposed in an interdigital relationship with each other. That is, the comb teeth of the comb-like wiring pattern 321*a* is formed to extend in a downward direction from a plus terminal 321 of a power supply portion and the LED elements 331*a* to 331*d*, 332*a* to 332*d*, 333*a* to 333*d* and 334*a* to 334*d* are mounted on the comb teeth of the comb-like wiring pattern 321*a*. In addition, the comb teeth of the comb-like wiring pattern 322*a* is formed to extend in an upward direction from a minus terminal 322 of the power supply portion and the comb teeth of the wiring pattern 321*a* are wire-bonded to the LED elements 331*a* to 331*d*, 332*a* to 332*d*, 333*a* to 333*d* and 334*a* to 334*d*.

As shown in FIG. 4A, the LED module 320 according to the first embodiment corresponds to a single wire type.

Figure 5:
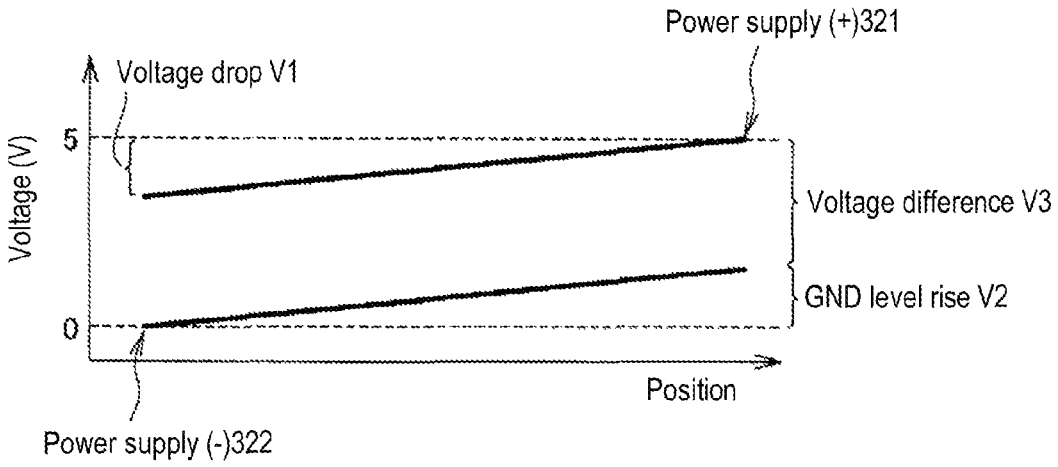
FIG. 5 is a view for illustrating a voltage difference between a plus (+) terminal of a power supply and a minus (−) terminal of the power supply according to the first embodiment.

Thus, a wiring length from one of the LED elements to the plus terminal 321 of the power supply portion and a wiring length from one of the LED elements to the minus terminal 322 of the power supply portion is substantially the same for all LED elements. For example, in FIG. 4B, a wiring pattern for the LED element 334*a* is indicated by a solid line L11 and a wiring pattern for the LED element 333*a* is indicated by a dashed line L12. As can be seen from FIG. 4B, the length of the solid line L11 is approximately equal to the length of the dashed line L12. In other words, the total length of current flow for all of the LED elements is substantially the same. Accordingly, as shown in FIG. 5, a variation of voltage drop V1 becomes approximately equal to a GND level rise V2 and a difference V3 between a voltage of the plus (+) terminal 321 of the power supply and the minus (−) terminal 322 of the power supply becomes constant. As a result, since a voltage applied to each LED element becomes constant, it is possible to emit light from each LED element with equal brightness.

(Configuration of LED Block of LED Module)

Figure 6:
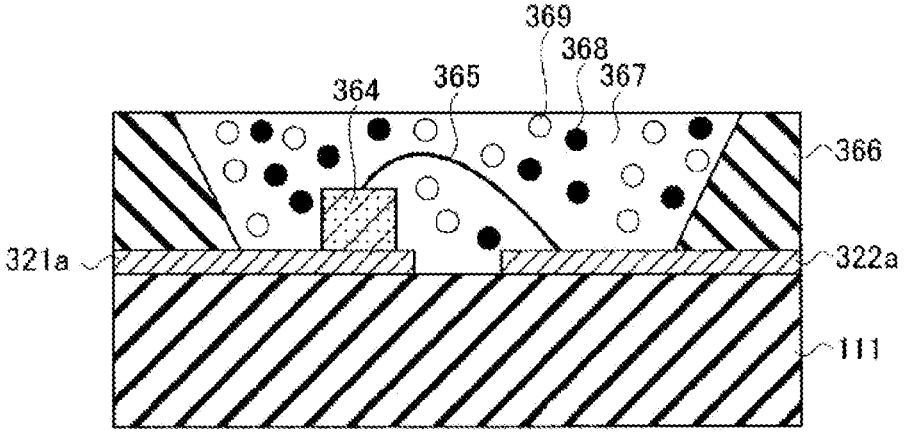
FIG. 6 is a schematic sectional view of the LED block of the LED module according to the first embodiment.

FIG. 6 is a schematic sectional view of an LED block of the LED module according to the first embodiment. FIG. 6 shows a sectional structure where an LED element 364 is mounted on the module substrate 111. As shown in FIG. 6, the wiring patterns 321*a* and 322*a* are formed on the module substrate 111. The LED element 364 is mounted on the wiring pattern 321*a* and a top electrode (not shown) of the LED element 364 is connected to the wiring pattern 322*a* by a bonding wire 365. A fluorescent layer 367 made by dispersing a first emission fluorescent material 368 and a second emission fluorescent material 369 in a transparent resin is provided within a white resin dam 366.

For example, the LED element 364 may be configured with a blue LED made of a nitride-based semiconductor. In this case, both of the first emission fluorescent material 368 and the second emission fluorescent material 369 may be a yellow fluorescent material. Alternatively, in order to secure color rendition, the first emission fluorescent material 368 and the second emission fluorescent material 369 may be a red fluorescent material and a green fluorescent material, respectively.

In this embodiment, examples of the yellow fluorescent material having the blue LED as an excitation light source may include a Ce-added YAG ($Y_3Al_5O_{12}$:Ce) fluorescent material, an Eu-added α-sialon (CaSiAlON:Eu) fluorescent material, a silicate fluorescent material ((Sr, Ba, Ca, Mg)$_2SiO_4$:Eu) and the like. That is, some of blue light of the blue LED is converted into yellow light by the yellow fluorescent material to obtain white light, which is a mixture of blue light and yellow light.

In addition, examples of the green fluorescent material having the blue LED as an excitation light source may include an Eu-added β-sialon ($Si_{6-z}Al_zO_zN_{8-z}$:Eu) fluorescent material, a Ce-added CSSO ($Ca_3Sc_2Si_3O_{12}$:Ce) fluorescent material and the like.

In addition, examples of the red fluorescent material having the blue LED as an excitation light source may include an Eu-added $CaAlSiN_3$ ($CaAlSiN_3$:Eu) fluorescent material and the like.

In addition, the LED element 364 may be configured with an ultraviolet LED made of a nitride-based semiconductor. In this case, both of the first emission fluorescent material 368 and the second emission fluorescent material 369 may be a yellow fluorescent material. Alternatively, in order to secure color rendition, the first emission fluorescent material 368 and the second emission fluorescent material 369 may be a red fluorescent material and a yellow fluorescent material, respectively.

Examples of the blue fluorescent material having the ultraviolet LED as an excitation light source may include ones capable of converting ultraviolet light into blue light, such as, for example, a halogen acid salts fluorescent material, an aluminate fluorescent material, a silicate fluorescent material and the like. In addition, examples of an activator material may include elements such as cerium, europium, manganese, gadolinium, samarium, terbium, tin, chromium, antimony and the like. Among these, europium, for example, may be used. The content of activator material in the fluorescent material may be within a range of 0.1 to 10 mol %.

The yellow fluorescent material having the ultraviolet LED as an excitation light source may be either a fluorescent material which absorbs blue light and emits yellow light or a fluorescent material which absorbs ultraviolet light and emits yellow light. In this embodiment, if the first emission fluorescent material 368 and the second emission fluorescent material 369 may be a red fluorescent material and a yellow fluorescent material, respectively, in order to secure color rendition, a fluorescent material which absorbs ultraviolet light and emits yellow light in order to, for example, further improve emission efficiency. Examples of the fluorescent material which absorbs blue light and emits yellow light may include organic fluorescent materials such as an arylsulfonamide•melamine formaldehyde cocondensation dye, a perylene-based fluorescent material and the like, and inorganic fluorescent materials such as aluminate, phosphate, silicate and the like. Among these, the perylene-based fluorescent material and the YAG-based fluorescent material may be utilized because of their long time usability. In addition, examples of an activator material may include elements such as cerium, europium, manganese, gadolinium, samarium, terbium, tin, chromium, antimony and the like. Among these, cerium, for example, may be used. The content of activator material in the fluorescent material may be within a range of 0.1 to 10 mol %. A combination of YAG and cerium may be, for example, a combination of the fluorescent material and the activator material.

In addition, examples of the fluorescent material which absorbs ultraviolet light and emits yellow light may include fluorescent materials such as (La, Ce)(P, Si)$O_4$, (Zn, Mg)O and the like. In addition, examples of an activator material may include terbium, zinc and the like.

The content of the first emission fluorescent material 368 and the second emission fluorescent material 369 in the fluorescent layer 367 may be within a range of 1 to 25 wt % although it may be properly determined depending on the types of LED elements 364 and fluorescent materials.

In addition, white LEDs may be mounted on the LED flash module according to this embodiment using a general-purpose package for LED mounting.

In addition, as one of LED configurations, white LEDs may be configured, for example by receiving "blue LEDs+green LEDs+red LEDs" in one package. As one example of such a multi-chip, a fluorescent material which emits yellow light by excitation of blue light may be combined with a multi-chip of "ultraviolet LEDs+blue LEDs". The yellow fluorescent material may be configured with one small-sized package since it is not affected by infrared light, and may be mounted in a smaller space since it occupies a smaller area.

(Method of Manufacturing LED Module)

Figure 7A:
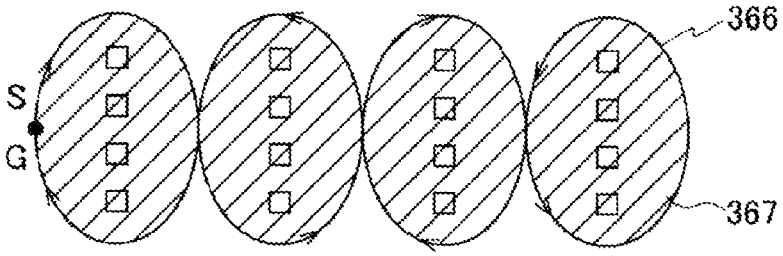
FIG. 7A is a schematic planar configuration view for illustrating a method of manufacturing the LED module according to the first embodiment, in which a white resin dam is coated in the form of a figure '8' shape around the LED elements.
Figure 7B:
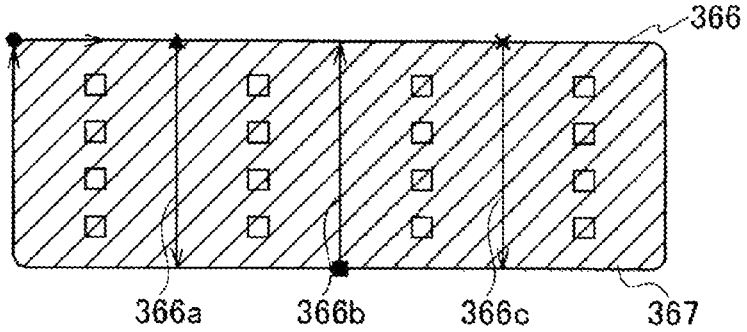
FIG. 7B is a schematic planar configuration view for illustrating a method of manufacturing the LED module according to the first embodiment, in which a white resin dam is coated in the form of a rectangle around the LED elements.
Figure 7C:
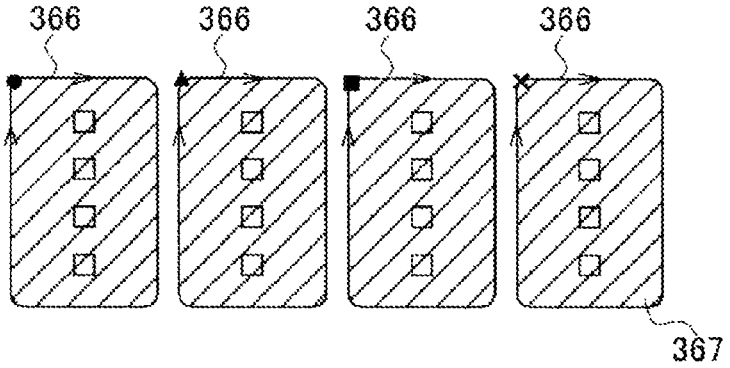
FIG. 7C is a schematic planar configuration view for illustrating a method of manufacturing the LED module according to the first embodiment, in which a white resin dam is coated in the form of a rectangle around the LED elements.

FIGS. 7A to 7C are schematic plan views used to illustrate a method of manufacturing the LED module 320 according to the first embodiment. In FIGS. 7A to 7C, a square indicates an LED element, a hatched area indicates a fluorescent layer 367, and a solid arrow indicates a coating path of a white resin dam 366. The height and width of the white resin dam 366 is 0.5 to 2.0 mm or so and 0.5 to 1.0 mm or so, respectively.

For example, as shown in FIG. 7A, the white resin dam 366 may be coated in the form of a figure '8' shape around the LED elements in such a manner that it has a closed area for respective LED block and the fluorescent layer 367 may be coated in the figure 8-shaped white resin dam 366. Alternatively, as shown in FIG. 7B, the white resin dam 366 may be coated in the form of a rectangle around the LED elements, and dams 336*a* to 336*c* acting as partitions may be coated in the rectangular white resin dam 366 in such a manner that they defines a closed area for respective LED block, and the fluorescent layer 367 may be coated in each closed area partitioned by the dams 366*a* to 366*c*. As another alternative, as shown in FIG. 7C, the white resin dam 366 may be coated in the form of a rectangle around the LED elements in such a manner that it has a closed area for respective LED block and the fluorescent layer 367 may be coated in the rectangular white resin dam 366.

As described above, the LED flash module 320 according to the first embodiment uses the energy device 18, such as an EDLC, to reduce time required for charging and achieve consecutive emissions and continuous lighting. In addition, the energy device 18 is used to realize low voltage and energy saving. In addition, the energy device 18 is so thin as to make the LED flash module more compact.

In addition, the LED flash module 320 according to the first embodiment is laid out in such a manner that the wiring length from one of the LED elements to the plus terminal 321 of the power supply portion and the wiring length from the one of the LED elements to the minus terminal 322 of the power supply portion is substantially the same for all LED elements. As a result, since voltage drops by the wirings are substantially equal to each other for all of the LED elements, it is possible to emit light from each LED element with equal brightness.

Figure 8A:
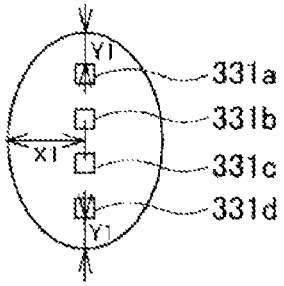
FIG. 8A is a schematic plan view for illustrating an effect of the LED flash module according to the first embodiment, showing one LED block.
Figure 8B:
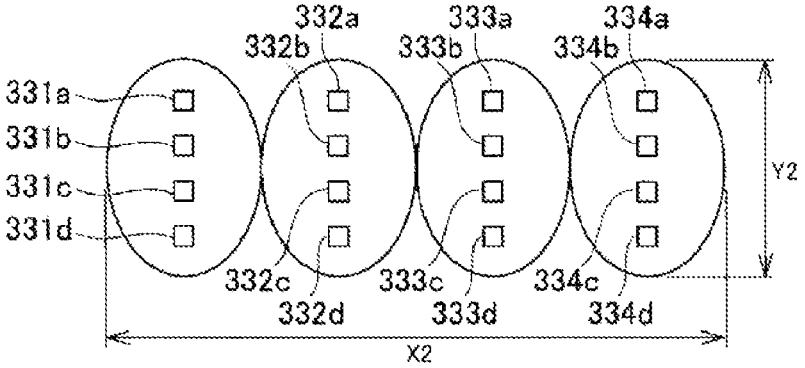
FIG. 8B is a schematic plan view for illustrating an effect of the LED flash module according to the first embodiment, showing four arranged LED blocks.

In addition, since the LED flash module according to this embodiment has the block configuration where the LED elements are vertically arranged, an extension (X1) of mutual relation with adjacent LED elements becomes larger than an extension (Y1) of one LED element, as shown in FIG. 8A. This allows a horizontal illumination angle to be widened, as shown in FIG. 8B (Y2<X2). When the required number of LED blocks is arranged, it is possible to easily cope with a wide angle such as a 16:9 aspect ratio or the like.

In addition, since the LED flash module according to the first embodiment uses a thin energy device such as EDLC, its volume may correspond to about 20% to 25% of a volume of conventional xenon lamps, which may result in its compactness and lightness.

In addition, since the LED flash module according to the first embodiment uses LED modules and an energy device such as EDLC, it is possible to reduce time required for charging with a low voltage operation.

Second Embodiment

A second embodiment will now be described with an emphasis placed on differences from the first embodiment.

Figure 9A:
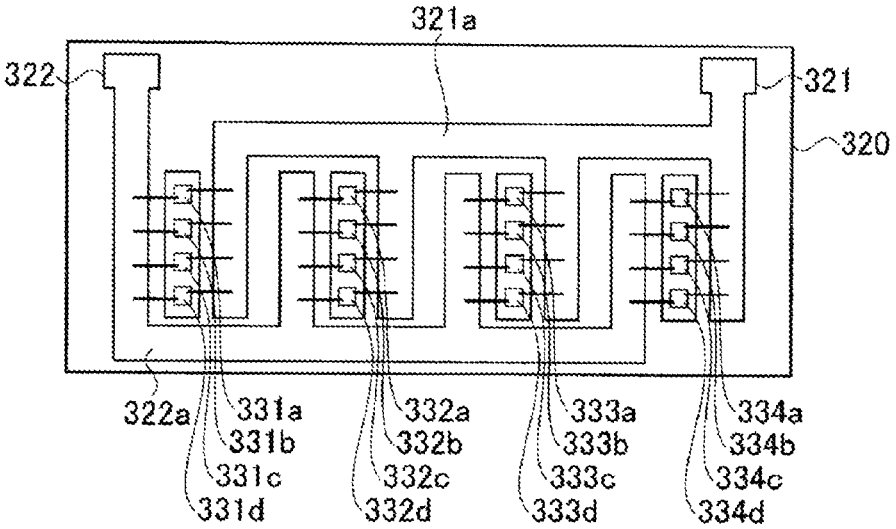
FIG. 9A is a schematic planar view of an LED module according to a second embodiment for illustrating a configuration of an LED block.

As shown in FIG. 9A, an LED module 320 according to the second embodiment includes a plurality of LED blocks arranged horizontally, each block including a plurality of LED elements arranged vertically. Like the first embodiment, it is here assumed that each group of LED elements 331*a* to 331*d*, 332*a* to 332*d*, 333*a* to 333*d* and 334*a* to 334*d* forms one LED block.

In addition, as shown in FIG. 9A, the LED module 320 according to the second embodiment includes a comb-like first wiring pattern 321*a* and a second comb-like wiring pattern 322*a*, the LED block has a floating island wiring patterns on which the LED elements 331*a* to 331*d*, 332*a* to 332*d*, 333*a* to 333*d* and 334*a* to 334*d* are mounted, and the LED elements 331*a* to 331*d*, 332*a* to 332*d*, 333*a* to 333*d* and 334*a* to 334*d* are wire-bonded to the first wiring pattern 321*a* and the second wiring pattern 322*a*.

As shown in FIG. 9A, in the second embodiment, the wiring patterns of the LED block has the floating island wiring patterns, and the comb-like wiring patterns 321*a* and 322*a* wire-bonded to the LED elements 331*a* to 331*d*, 332*a* to 332*d*, 333*a* to 333*d* and 334*a* to 334*d* are disposed in an interdigital relationship with each other. That is, the LED elements 331*a* to 331*d*, 332*a* to 332*d*, 333*a* to 333*d* and 334*a* to 334*d* are mounted on the respective individual floating island-shaped wiring patterns. In addition, the comb teeth of the comb-like wiring pattern 321*a* is formed to extend in a downward direction from a plus terminal 321 of a power supply portion and the LED elements 331*a* to 331*d*, 332*a* to 332*d*, 333*a* to 333*d* and 334*a* to 334*d* are mounted on the comb teeth of the comb-like wiring pattern 321*a*. In addition, the comb teeth of the comb-like wiring pattern 322*a* is formed to extend in an upward direction from a minus terminal 322 of the power supply portion and the comb teeth of the comb-like wiring pattern 321*a* are wire-bonded to the LED elements 331*a* to 331*d*, 332*a* to 332*d*, 333*a* to 333*d* and 334*a* to 334*d*.

As shown in FIG. 9A, the LED module 320 according to the second embodiment corresponds to a double wire type.

Figure 9B:
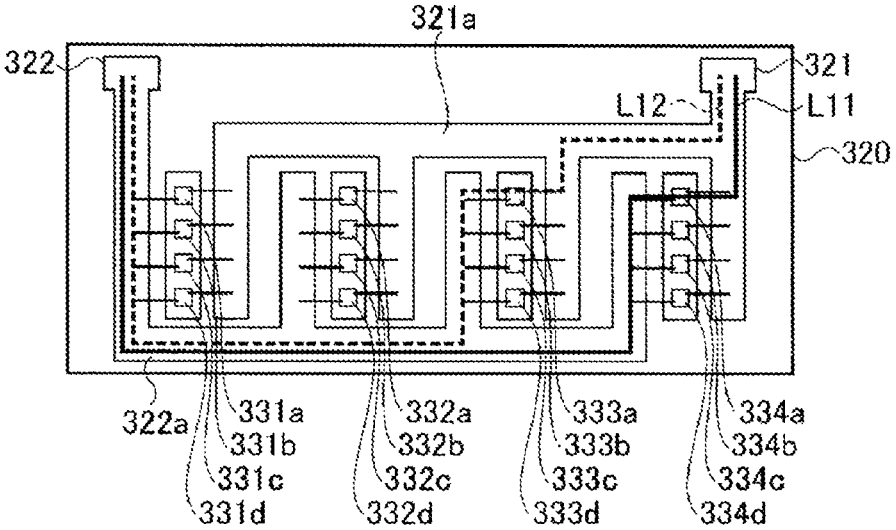
FIG. 9B is a schematic plan view of the LED module according to the second embodiment for illustrating a wiring length.

Thus, a wiring length from a plus terminal 321 of the power supply portion to one LED element and a wiring length from the LED element to a minus terminal 322 of the power supply portion is substantially the same for all of the LED elements. For example, in FIG. 9B, a wiring pattern for the LED element 334*a* is indicated by a solid line L11 and a wiring pattern for the LED element 333*a* is indicated by a dashed line L12. As can be seen from FIG. 9B, the length of the solid line L11 is approximately equal to the length of the dashed line L12. In other words, the total length of current flow for all of the LED elements is substantially the same. As a result, like the first embodiment, since a voltage applied to each LED element becomes constant, it is possible to emit light from each LED element with equal brightness.

As described above, in the LED flash module 320 according to the second embodiment, the wiring patterns of the LED block are in the form of floating island and the wiring patterns 321*a* and 322*a* wire-bonded to the LED elements 331*a* to 331*d*, 332*a* to 332*d*, 333*a* to 333*d* and 334*a* to 334*d* are in the interdigital form. With this configuration, since voltage drops by the wirings are substantially equal to each other for the LED elements, the same effects as the first embodiment can be achieved.

In addition, since the LED flash module according to the second embodiment uses a thin energy device such as EDLC, its volume may correspond to about 20% to 25% of a volume of conventional xenon lamps, which may result in a more compact and brighter light source.

In addition, since the LED flash module according to the second embodiment uses LED modules and the energy device 18 such as EDLC, it is possible to reduce the time required for charging using a low voltage operation.

Third Embodiment

A third embodiment will now be described with an emphasis placed on differences from the first and second embodiments with reference to FIGS. 10A to 14.

(Configuration of LED Flash Module)

An LED flash module according to a third embodiment includes a module substrate 111; an energy device (for example, EDLC) 18, which is disposed on the module substrate 111 and has a laminated body of two or more layers including positive and negative active material electrodes and positive and negative lead-out electrodes 34, which are integrally formed, and a separator 30 (see FIGS. 40 to 42) which is interposed between the positive and negative active material electrodes and passes electrolytes and ions, the two or more layers being laminated such that the lead-out electrodes 34 are exposed from the positive and negative active material electrodes and the positive and negative active material electrodes are alternated; an LED module 320 which is arranged on the module substrate 111 and includes a plurality of LED blocks 320*g* and 320*h* arranged in a first direction (for example, a horizontal direction), each LED block including a plurality of LED elements which is arranged in a second direction (for example, a vertical direction) perpendicular to the first direction and emits light with power supplied from the energy device 18; an EDLC charger circuit 311 which is arranged on the module substrate 111 and charges the energy device 18; and an LED driver control circuit 313 which is arranged on the module substrate 111 and controls emission of the LED elements, wherein color rendition of the LED blocks 320*g* and 320*h* is variable.

The LED driver control circuit 313 drives the LED blocks 320*g* and 320*h* individually and controls at least one of a value of current flowing into each of the LED blocks 320*g* and 320*h* and lighting time.

Figure 10A:
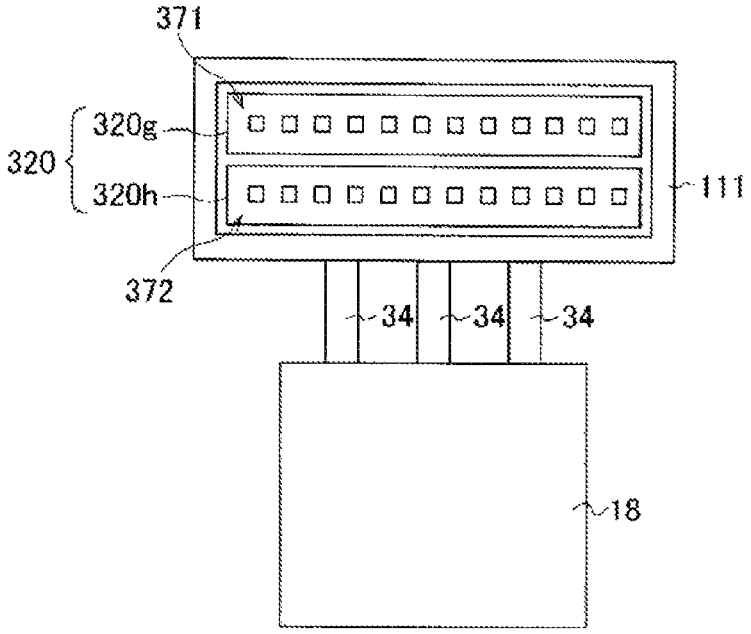
FIG. 10A is a schematic plan view of an LED flash module according to a third embodiment, when viewed from a front surface of the LED flash module.
Figure 10B:
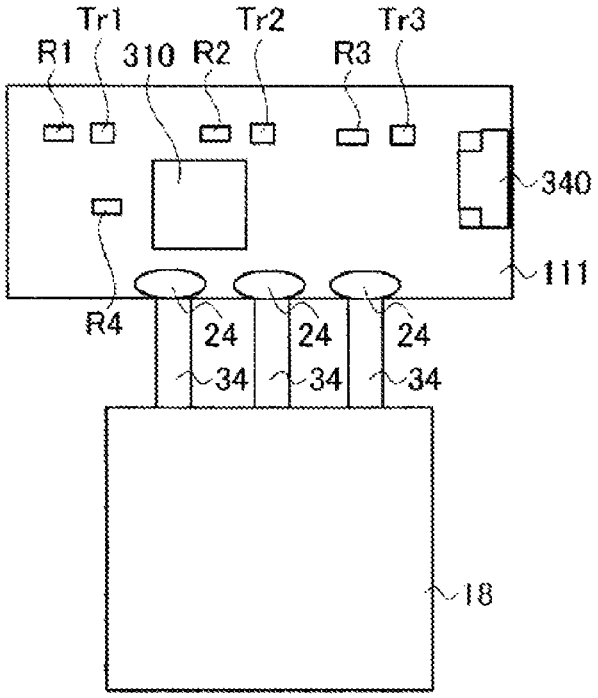
FIG. 10B is a schematic plan view of the LED flash module according to a third embodiment, when viewed from a rear surface of the LED flash module.

FIGS. 10A and 10B are schematic plan views of the LED flash module according to the third embodiment, when viewed from front and rear surfaces of the LED flash module, respectively. As shown in FIG. 10A, an LED module 320 is mounted on a surface of a module substrate 111. The LED module 320 includes 2 LED blocks 320*g* and 320*h* horizontally arranged. Each of the LED blocks 320*g* and 320*h* includes a plurality of LED elements arranged vertically. A white resin dam 366 is coated around the LED elements and fluorescent layers 371 and 372 having different color renditions are coated on a region surrounded by the white resin dam 366 (which will be described later). The rear surface of the module substrate 111 has the same configuration as that in the first embodiment, as shown in FIG. 10B.

Figure 11:
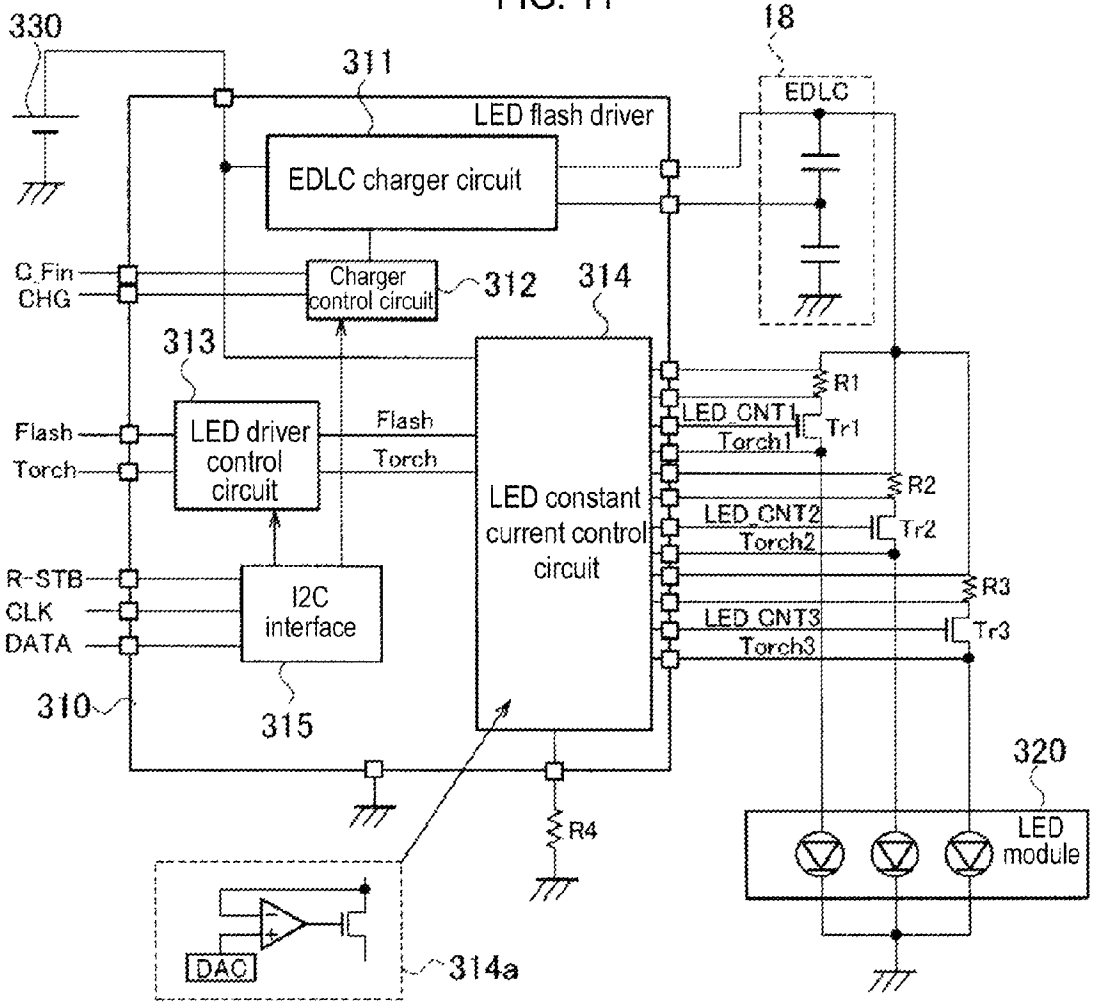
FIG. 11 is a schematic circuit block diagram of the LED flash module according to the third embodiment.

FIG. 11 is a schematic block diagram of the LED flash module according to the third embodiment. This LED flash module includes, but is not limited to, an I2C interface 315 in communication with a microcomputer (not shown) and so on. The I2C interface 315 is connected to the charger control circuit 312 and the LED driver control circuit 313. The LED driver control circuit 313 can selectively turns on/off desired ones of the plurality of LED elements in the LED block. In addition, this circuit can selectively turns on/off a particular area of the LED block. The LED constant current control circuit 314 includes a DAC (Digital Analog Converter) 314*a* for each LED block. Other configurations have basically the same as those in the first embodiment.

(Operation of LED Flash Module)

Figure 12A:
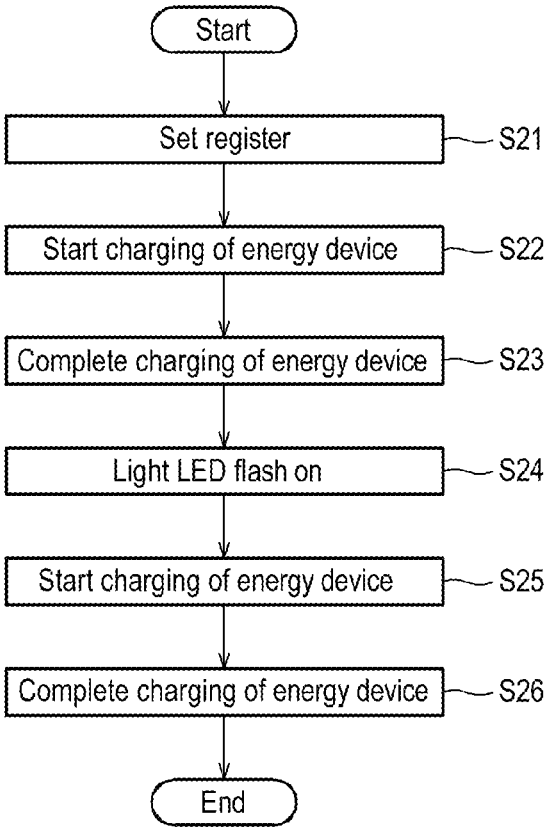
FIG. 12A is a flow chart for illustrating an operation of an energy device at the time of charging in the LED flash module according to the third embodiment.
Figure 12B:
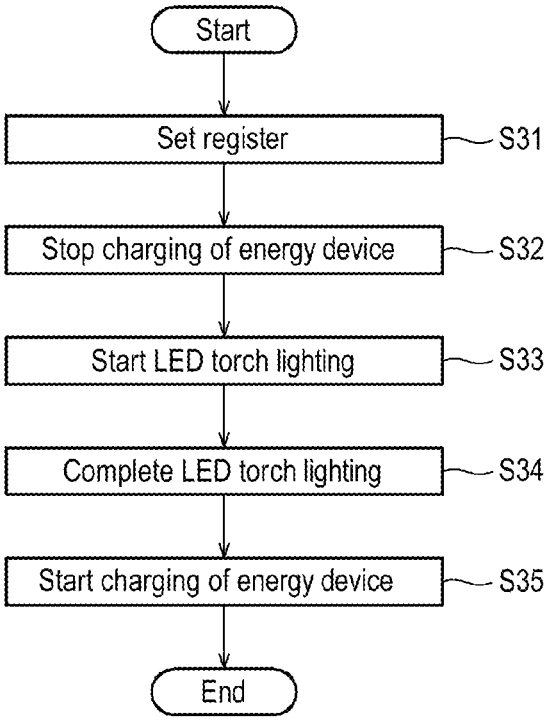
FIG. 12B is a flow chart for illustrating an operation in an LED torch mode in the LED flash module according to the third embodiment.

When the LED flash module is powered on, a value of current flowing into each LED block and lighting time are input from the microcomputer to the LED flash module and are set in a register of the I2C interface 315 (Step S22 in FIG. 12A). The current value and the lighting time are properly determined depending on the circumstances. Thereafter, an operation performed until the LED flash is lit on after the charging of the energy device 18 is completed is the same as that in the first embodiment (Steps S22 to S24 in FIG. 12A). The current in the LED flash mode is adjusted by external attachment resistors R1 to R3 and a DAC 314*a*. The current in the LED torch mode is adjusted by an external attachment resistor R4 and the DAC 314*a* (Steps S33 and S34 in FIG. 12B).

The LED driver control circuit 313 according to the third embodiment drives the LED blocks individually and controls a value of current flowing into each LED block and lighting time. At that time, a current value and lighting time preset in a register for each LED block is referenced. Lighting time control may use a pulse modulation method such as PWM (Pulse Width Modulation), PNM (Pulse Number Modulation) or the like. One or both of the current value and the lighting time may be controlled. For example, the current value may be roughly adjusted and then the lighting time may be finely adjusted.

(Configuration of LED Module)

Figure 13A:
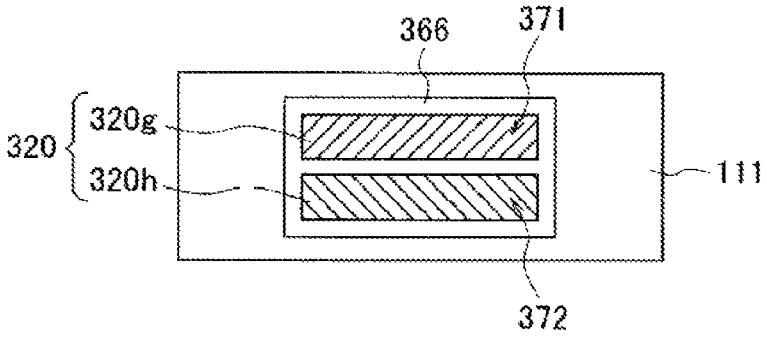
FIG. 13A is a schematic plan view of an LED module according to the third embodiment for illustrating a configuration of a rectangular LED block.
Figure 13B:
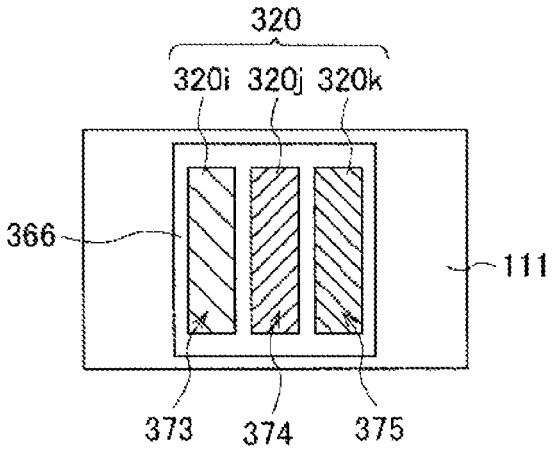
FIG. 13B is a schematic plan view of an LED module according to the third embodiment for illustrating a configuration of a square LED block.

As shown in FIGS. 13A and 13B, the LED module 320 according to the third embodiment may include the white resin dam 366 coated around the LED elements and the fluorescent layers 371 and 372 which have different color renditions and are coated on a region surrounded by the white resin dam 366.

FIG. 13A is a schematic plan view of a rectangular LED module 320, showing two LED blocks 320*a* and 320*h* arranged vertically, with a yellow fluorescent layer 371 coated on the LED block 320*g* and a red•yellow fluorescent layer 372 coated on the LED block 320*h*.

FIG. 13B is a schematic plan view of a rectangular LED module 320, showing three LED blocks 320*i*, 320*j* and 320*k* arranged vertically, with a green•yellow fluorescent layer 373 coated on the LED block 320*i*, a yellow fluorescent layer 374 coated on the LED block 320*j* and a red•yellow fluorescent layer 375 coated on the LED block 320*k*.

In this manner, fluorescent layers having different color renditions are coated on different LED blocks to control a current value flowing into each LED block and lighting time. Thus, an emission balance for each LED block is varied to provide a variable color rendition.

(Fluorescent Layer)

Figure 14:
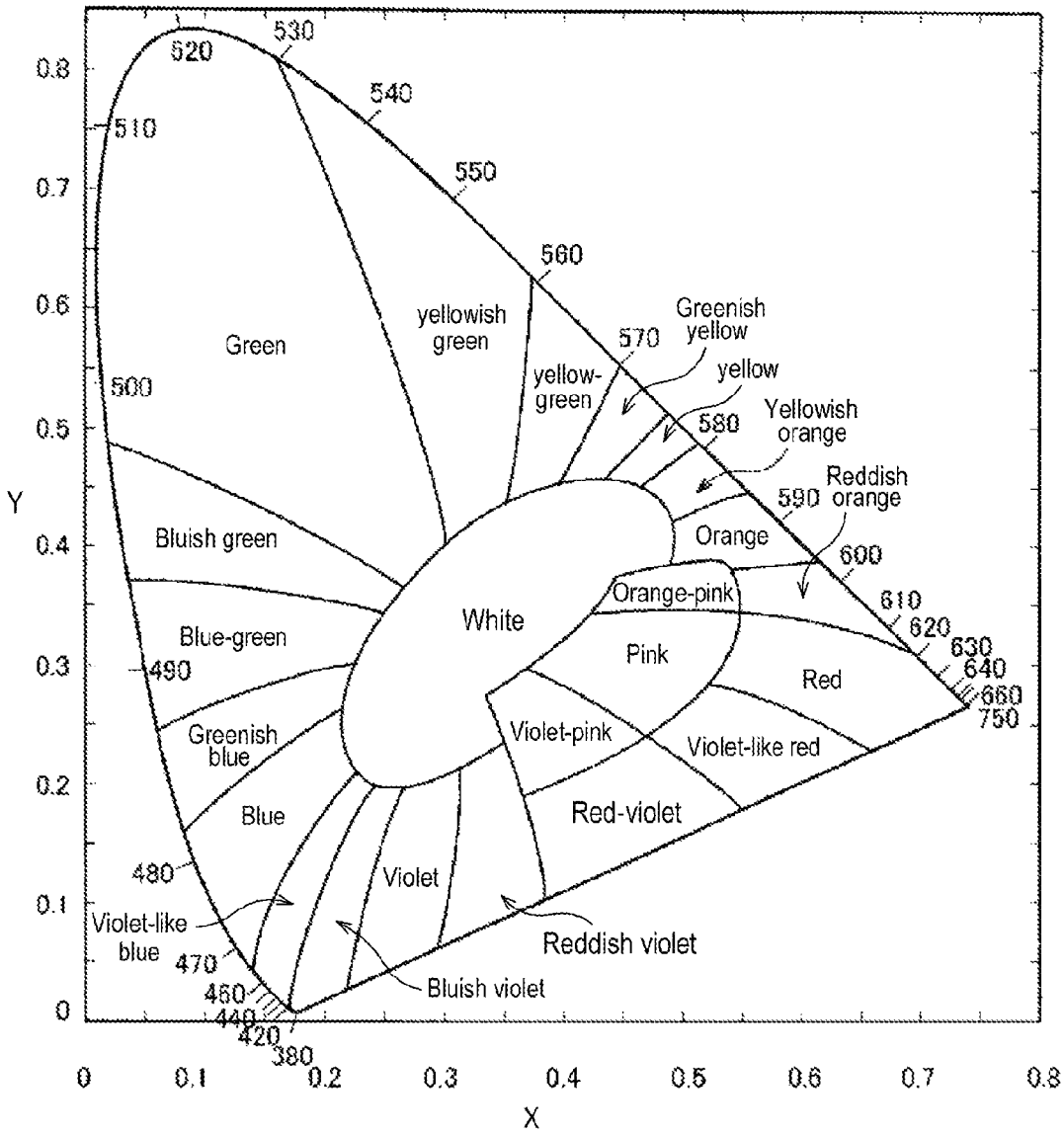
FIG. 14 is an XY chromaticity diagram of an XYZ colorimetric system according to CIE (Commission Internationale de L 'Eclairage) 1931.

FIG. 14 shows an XY chromaticity diagram of an XYZ colorimetric system according to CIE (Commission Internationale de L 'Eclairage) 1931. This XY chromaticity diagram can be referenced to select a fluorescent layer. That is, different combinations of fluorescent layers having different color renditions can be employed. The material of the fluorescent layers is the same as that described in the first embodiment and therefore, details of which are not repeated for the purpose of brevity.

As described above, the LED flash module according to the third embodiment includes the LED blocks 320*g* and 320*h* having a variable color rendition. Therefore, when the LED flash module is applied to imaging devices such as digital cameras, video cameras and so on, its color rendition can be varied depending on the circumstances, thereby providing arrangements different from before.

In addition, in this embodiment, the color rendition can be varied with the LED flash module instead of an image process. Although a xenon lamp having a fixed color rendition needs to change the color rendition using an image process, the third embodiment can alleviate a load of such an image process.

In addition, although different fluorescent layers having different color renditions are illustrated in this embodiment, the present disclosure is not limited thereto. For example, different combinations of LEDs having different emission colors may provide different color renditions through control of the value of current flowing into each LED and the lighting time.

Fourth Embodiment

A fourth embodiment will now be described with an emphasis placed on differences from the first to third embodiments with reference to FIGS. 15A to 19C.

An LED flash module according to a fourth embodiment includes a module substrate 111; an energy device (for example, EDLC) 18 which is disposed on the module substrate 111 and has a laminated body of two or more layers including positive and negative active material electrodes and positive and negative lead-out electrodes 34, which are integrally formed, and a separator 30 (see FIGS. 40 to 42), which is interposed between the positive and negative active material electrodes and passes electrolytes and ions, the two or more layers being laminated such that the lead-out electrodes 34 are exposed from the positive and negative active material electrodes and the positive and negative active material electrodes are alternated; an LED module 320 which is arranged on the module substrate 111 and includes a plurality of LED blocks 320*g* and 320*h* arranged in a first direction (for example, a horizontal direction), each LED block including a plurality of LED elements which is arranged in a second direction (for example, a vertical direction) perpendicular to the first direction and emits light with power supplied from the energy device 18; an EDLC charger circuit 311 which is arranged on the module substrate 111 and charges the energy device 18; and an LED driver control circuit 313 which is arranged on the module substrate 111 and controls emission of the LED elements, wherein, when the LED elements are arranged in plural rows, anode electrodes A or cathode electrodes C of LED elements 364 in adjacent rows 364*h* and 364*l* are arranged to face with each other and an anode wiring or a cathode wiring on the module substrate 111 is a common wiring C11.

COMPARATIVE EXAMPLE

Figure 15A:
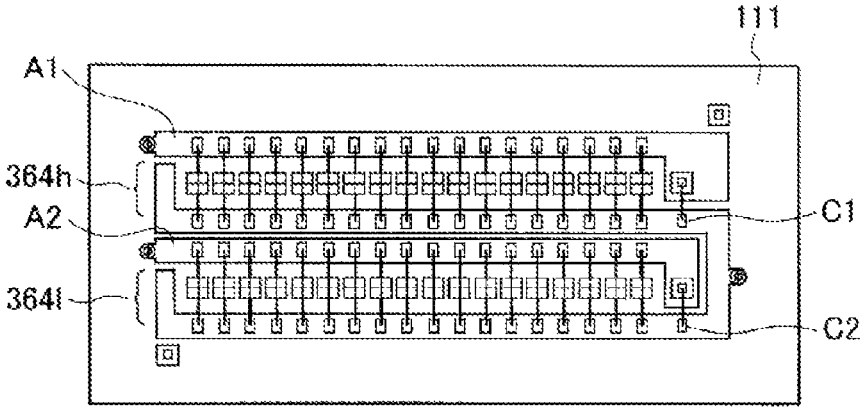
FIG. 15A is a schematic planar pattern configuration view showing an example of arrangement of LED elements according to a fourth embodiment.
Figure 15B:
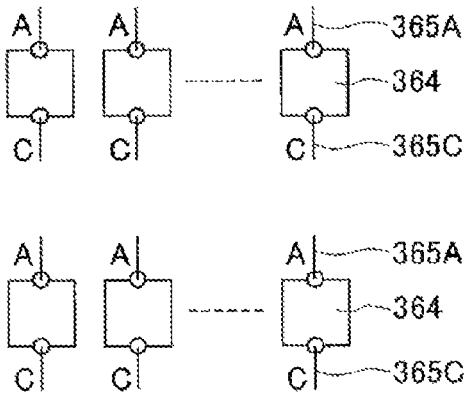
FIG. 15B shows partial enlargement of FIG. 15A.

FIGS. 15A and 15B are schematic planar pattern configuration views showing an example of arrangement of LED elements 364 according to a fourth embodiment, showing two-row arrangement of the LED elements 364. FIG. 15B shows partial enlargement of FIG. 15A. As shown in FIGS. 15A and 15B, the two-row arrangement of the LED elements 364 requires anode wirings A1 and A2 and cathode wirings C1 and C2 at both sides of each LED element 364.

That is, in FIGS. 15A and 15B, anode electrodes A of the LED elements 364 forming an upper row 364*h* are connected to the anode wiring A1 on the module substrate 111 via bonding wires 365A such as, for example, Au wires and so on. On the other hand, cathode electrodes C of the LED elements 364 forming the upper row 364*h* are connected to the cathode wiring C1 on the module substrate 111 via bonding wires 365C.

In addition, in FIGS. 15A and 15B, anode electrodes A of the LED elements 364 forming a lower row 364*l* are connected to the anode wiring A2 on the module substrate 111 via the bonding wires 365A. On the other hand, cathode electrodes C of the LED elements 364 forming the lower row 364*l* are connected to the cathode wiring C2 on the module substrate 111 via bonding wires 365C.

(Example of Zigzag-Shaped Arrangement)

Figure 16A:
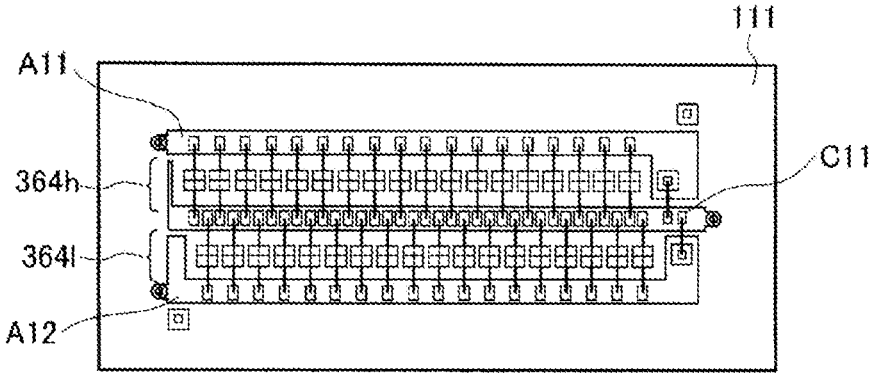
FIG. 16A is a schematic planar pattern configuration view showing another example of arrangement of LED elements according to the fourth embodiment.
Figure 16B:
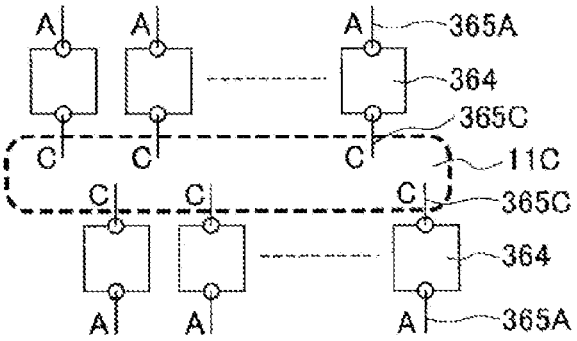
FIG. 16B shows partial enlargement of FIG. 16A.

FIGS. 16A and 16B are schematic planar pattern configuration views showing an example of arrangement of LED elements 364 according to the fourth embodiment, showing two-row arrangement of the LED elements 364. In this example, cathode electrodes C of LED elements 364 of adjacent rows 364*h* and 364*l* are arranged to face with each other. Accordingly, cathode wirings can be made common to allow all of the cathode electrodes C to be connected to the common wiring C11 on the module substrate 111. Thus, since the number of wirings on the module substrate 111 can be made smaller than that in the comparative example, it is possible to make width between the rows 364*h* and 364*l* smaller, thereby reducing an area of the module substrate 111.

In addition, in this example, the LED elements 364 are arranged in the form of zigzag for each row 364*h* and 364*l*. Thus, since the bonding wires 365A and 365C are mounted perpendicular to the common electrode C11, the length thereof can be made shortest.

(Example of the Same Row Arrangement)

Figure 17A:
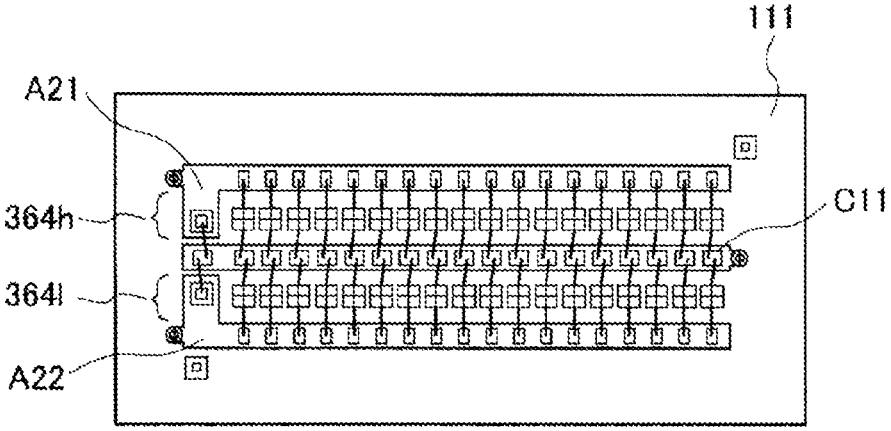
FIG. 17A is a schematic planar pattern configuration view showing another example of arrangement of LED elements according to the fourth embodiment.
Figure 17B:
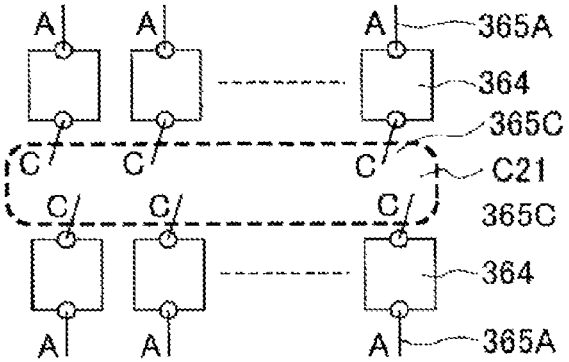
FIG. 17B shows partial enlargement of FIG. 17A.

FIGS. 17A and 17B are schematic planar pattern configuration views showing an example of arrangement of LED elements 364 according to the fourth embodiment. In this example, like FIGS. 16A and 16B, cathode electrodes C of LED elements 364 of adjacent rows 364*h* and 364*l* are arranged to face with each other. Thus, an area of the module substrate 111 can be reduced in a manner similar to FIGS. 16A and 16B.

In this example, the LED elements 364 are in the same row arrangement. The phase "the same raw arrangement" refers to arrangement of the rows 364*h* and 364*l* in the same longitudinal direction. Thus, the horizontal width (in X direction) of the module substrate 111 can be made smaller than that in FIGS. 16A and 16B.

In addition, when the LED elements 364 are in the same row arrangement, the bonding wire 365C is mounted in a direction inclined with respect to the common electrode C21. This can prevent the facing bonding wires 365C from contacting with each other.

(Example of Three-Row Arrangement)

Figure 18A:
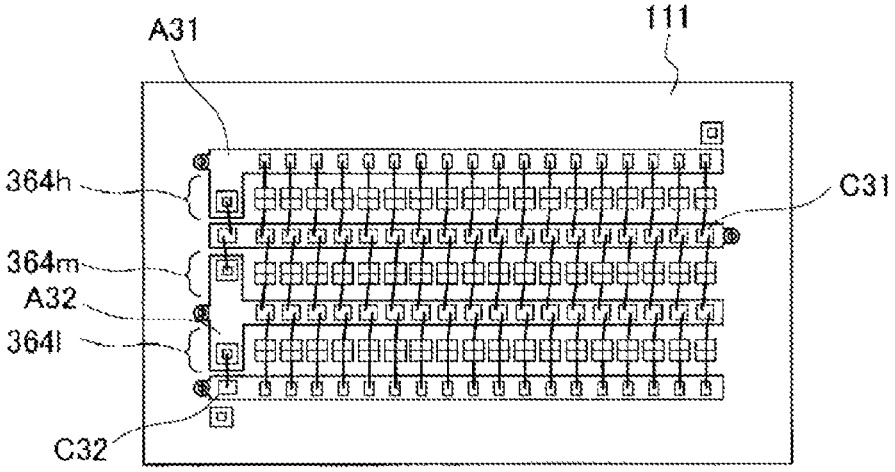
FIG. 18A is a schematic planar pattern configuration view showing another example of arrangement of LED elements according to the fourth embodiment.
Figure 18B:
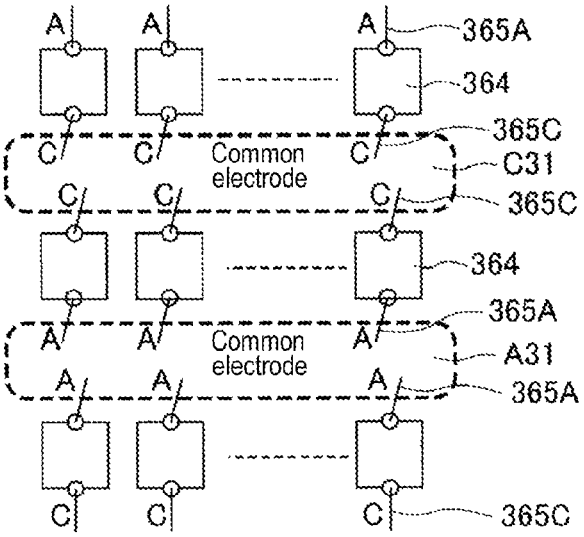
FIG. 18B shows partial enlargement of FIG. 18A.

FIGS. 18A and 18B are schematic planar pattern configuration views showing an example of arrangement of LED elements 364 according to the fourth embodiment, showing three-row arrangement of the LED elements 364.

As shown in FIGS. 18A and 18B, cathode electrodes C of LED elements 364 of adjacent rows 364*h* and 364*m* are arranged to face with each other. In addition, anode electrodes A of LED elements 364 of adjacent rows 364*m* and 364*l* are arranged to face with each other. Accordingly, all of the cathode electrodes C can be connected to the common wiring C31 on the module substrate 111 and all of the anode electrodes A can be connected to the common electrode A31 on the module substrate 111. Thus, since the number of wirings on the module substrate 111 is made smaller than that in the comparative example, thereby further reducing the area of the module substrate 111.

It should be understood that the number of wirings can be reduced by one line whenever the number of rows of the LED elements increases by one, in case of four or more-row arrangement of LED elements 364. That is, since a layout can be repeated when the number of rows is increased, LED elements 364 can be mounted with higher density according to the increase in the number of rows of the LED elements, which may result in smaller product size.

(Sectional Structure)

Figure 19A:
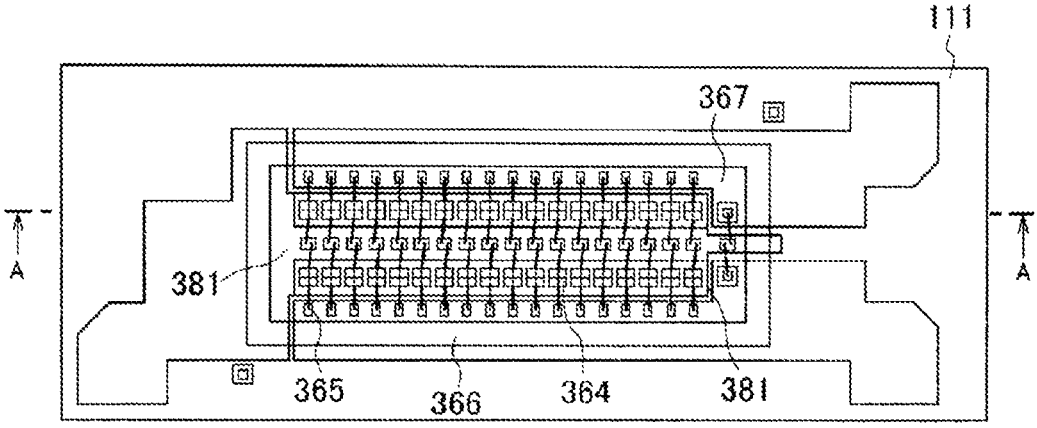
FIG. 19A is a schematic planar pattern configuration view showing an example of a sectional structure of a module substrate according to the fourth embodiment.
Figure 19B:
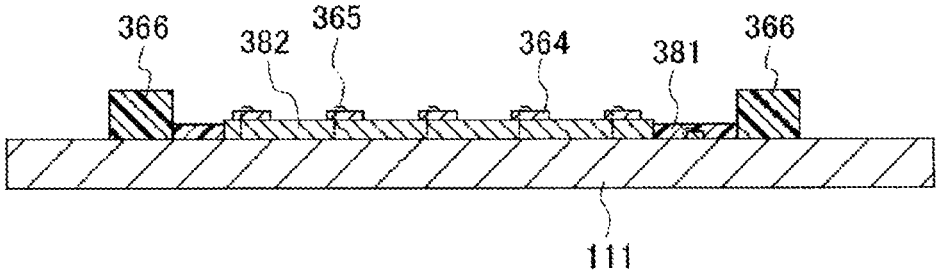
FIG. 19B is a sectional view taken along line A-A in FIG. 19A, showing a condition where a white resin is applied.
Figure 19C:
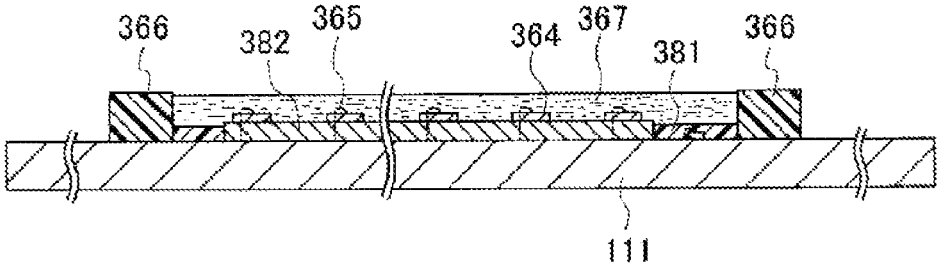
FIG. 19C is a sectional view taken along line A-A in FIG. 19A, showing a condition where a fluorescent layer is applied.

FIGS. 19A to 19C show examples of a sectional structure of the module substrate 111 according to the fourth embodiment, FIG. 19A being a schematic planar pattern configuration view, FIG. 19B being a sectional view taken along line A-A in FIG. 19A, showing a condition where a white resin 381 is applied, and FIG. 19C being a sectional view taken along line A-A in FIG. 19A, showing a condition where a fluorescent layer 367 is applied.

As described previously, this embodiment employs the COB structure. That is, an LED bear chip (LED elements 364) divided into several LED blocks are mounted on the module substrate 111 in the form of an array and is electrically bonded to the module substrate 111 by means of bonding wires 365. A volume compensating dummy chip 382 such as a Si chip or the like is mounted below the LED elements 364. The white resin 381 is used to increase reflection efficiency of the LED elements 364. In this condition, a silicon-based white resin coated for each LED block to produce a dam 366 and the fluorescent layer 367 is coated on the inner side of the dam 366. The LED blocks are made of the same resin but at least two kinds of different fluorescent layers are coated on different LED blocks.

Although two-row arrangement of LED elements 364 in the inner side of one dam 366 is herein illustrated, an additional dam 366 may be formed between the two-row arranged LED elements 364. In this case, it should be understood that different fluorescent layers 367 may be coated for different rows (different LED blocks) divided by the additional dam 366.

As described above, in the LED flash module according to this embodiment, when a plurality of rows of LED elements 364 is arranged, the anode electrodes A or the cathode electrodes C of the LED elements 364 in adjacent rows 364*h* and 364*l* are arranged to face each other and the anode wiring or the cathode wiring on the module substrate 111 is the common wiring C11. Thus, since the number of wirings on the module substrate 111 is reduced, the area of the module substrate 111 is accordingly reduced, which may result in smaller product size. In addition, since more LED elements 364 can be mounted in the same area, it is possible to realize products with higher luminance.

In addition, although multi-row arrangement of LED elements 364 is herein illustrated, the present disclosure is not limited thereto. In other words, such arrangement is not limited to LED elements 364 but may be applied to different elements which require multi-row arrangement.

(Laminated Energy Device)

A laminated energy device 18 which may be applied to the LED flash modules according to the first to fourth embodiments will be now described. The laminated energy device 18 can be mounted on the module substrate 111 in different ways with no particular limitation. For example, the laminated energy device 18 may be mounted on the module substrate 111 as below. In the following description of a method of mounting the laminated energy device 18, it is configured that light emitted from LED elements is not blocked by the laminated energy device 18, although a positional relationship between the LED elements and the laminated energy device 18 may not be explicitly stated.

Figure 20:
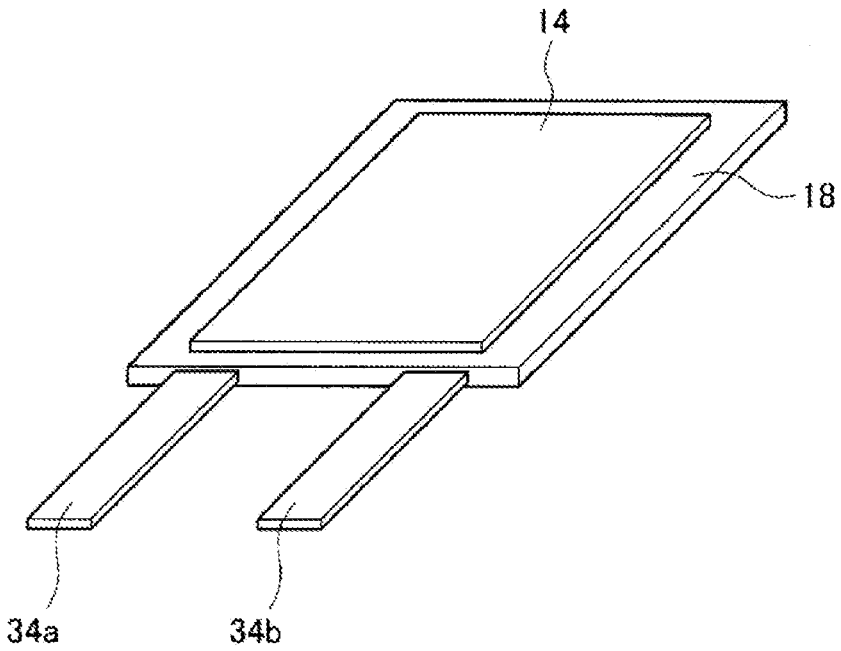
FIG. 20 is a schematic bird's eye structural view of a laminated energy device which may be applied to the LED flash modules according to the first to fourth embodiments.
Figure 21:
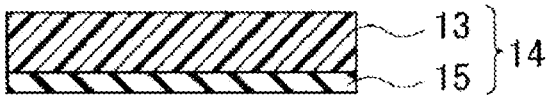
FIG. 21 is a schematic sectional view of a sealing part of the laminated energy device which may be applied to the LED flash modules according to the first to fourth embodiments.

FIG. 20 is a bird's eye structural view of the laminated energy device 18 which may be applied to the LED flash modules according to the first to fourth embodiments. As shown in FIG. 20, a sealing member 14 is mounted in one surface of a laminate sheet covering a body of the laminated energy device 18. As shown in FIG. 21, the sealing member 14 includes a sticking agent 13 coated on the one side of the laminate sheet and a release paper 15 covering a surface of the sticking agent 13. An insulating material having thermal conductivity, for example, may be used for the sticking agent 13. The release paper 15 is made by performing a peeling process for a surface of paper. A method of attaching the sealing member 14 to the laminate sheet is not particularly limited. For example, it is convenient to peel off a release paper of one side of a double-sided tape and attach the one side to the laminate sheet. Although the attachment of the sealing member 14 to one side of the laminate sheet is herein illustrated, the sealing member 14 may be attached to both sides of the laminate sheet.

—Mounting Method—

Subsequently, a method of mounting the laminated energy device 18 will be described.

Figure 22A:
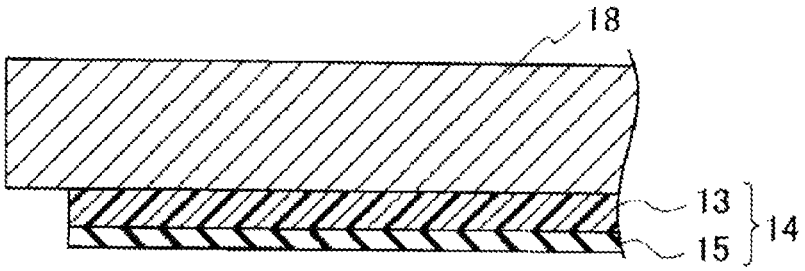
FIG. 22A is a schematic sectional view for illustrating a method of mounting the laminated energy device which may be applied to the LED flash modules according to the first to fourth embodiments, showing a condition before a release paper is peeled off.
Figure 22B:
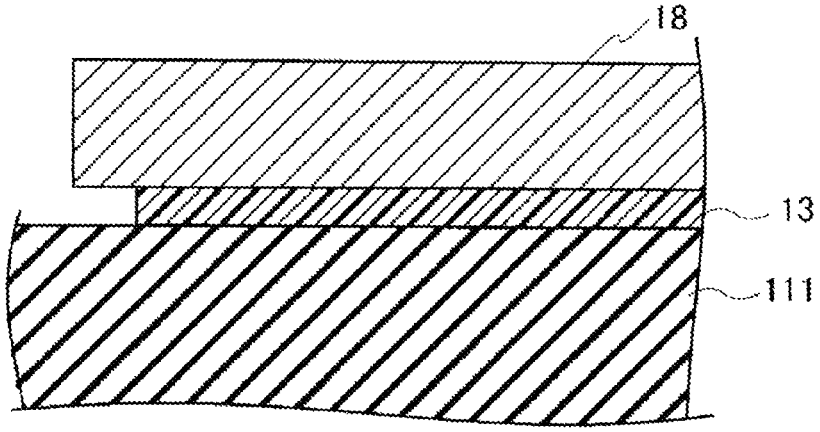
FIG. 22B is a schematic sectional view for illustrating a method of mounting the laminated energy device which may be applied to the LED flash modules according to the first to fourth embodiments, showing a condition after a release paper is peeled off.
Figure 23:
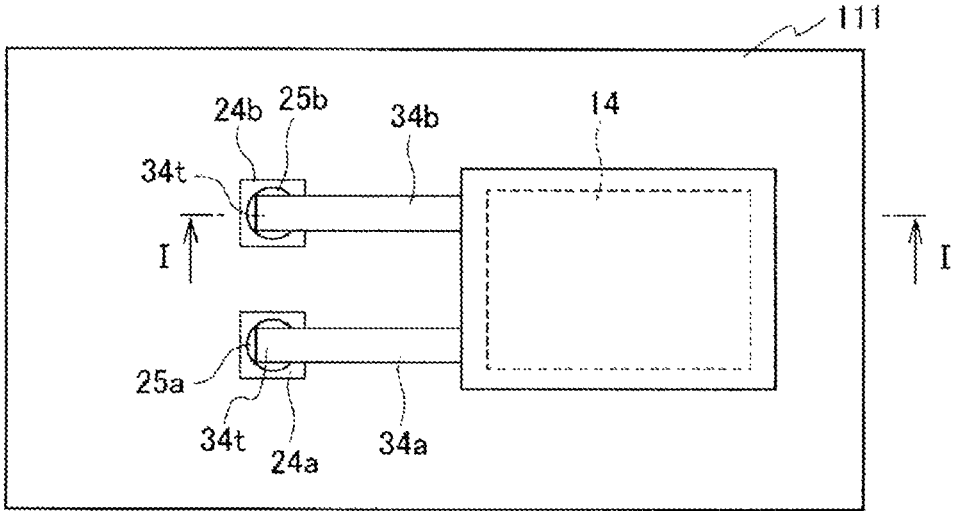
FIG. 23 is a schematic planar pattern configuration view of a module substrate mounting the laminated energy device which may be applied to the LED flash modules according to the first to fourth embodiments.
Figure 24:
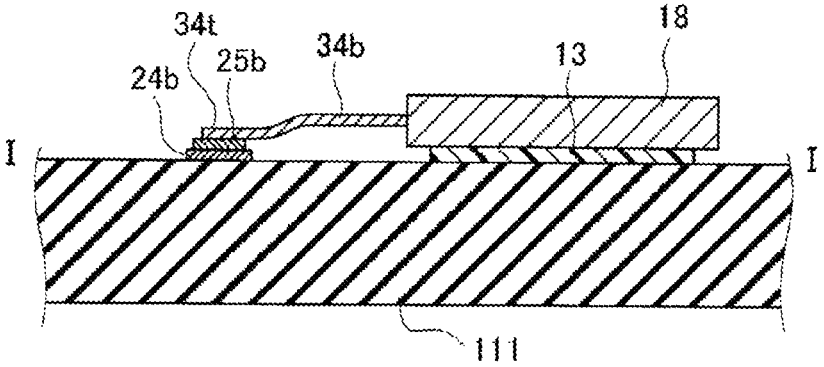
FIG. 24 is a schematic sectional view of the module substrate mounting the laminated energy device which may be applied to the LED flash modules according to the first to fourth embodiments.
Figure 25:
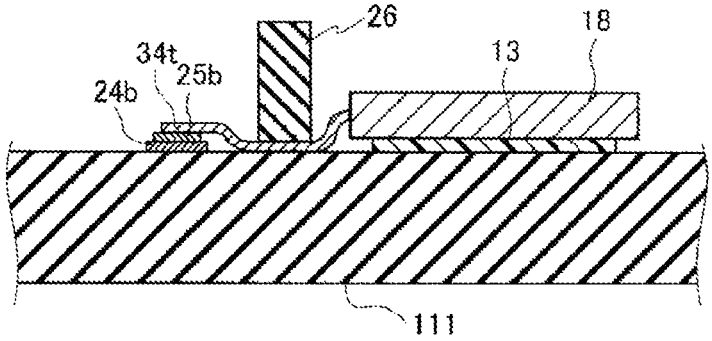
FIG. 25 is a schematic sectional view of the module substrate mounting the laminated energy device which may be applied to the LED flash modules according to the first to fourth embodiments.

First, the release paper 15 covering the laminate sheet is peeled off, as shown in FIG. 22A. With the sticking agent 13 exposed to a portion where the release paper 15 is peeled off, the laminated energy device 18 is fixed to a predetermined mounting position on the module substrate 111, as shown in FIG. 22B. FIG. 23 is a schematic planar pattern configuration view of the module substrate 111 in this state and FIG. 24 is a schematic sectional view taken along line I-I in FIG. 23. As shown in FIGS. 23 and 24, leading ends 34*t* of lead-out electrodes 34*a* and 34*b* are arranged to be set near welding holes 25*a* and 25*b* of solder connections 24*a* and 24*b*. At this point, the long and soft lead-out electrodes 34*a* and 34*b* are in an unstable state as they are not fixed to the module substrate 111, while a body of the laminated energy device 18 is fixed to the module substrate 111 by means of the sticking agent 13. Here, as shown in FIG. 25, a heat-resistant rubber 26 or the like is used to press the lead-out electrodes 34*a* and 34*b* against the module substrate 111 and solder welding (electrical connection) to the welding holes 25*a* and 25*b* of the solder connections 24*a* and 24*b* is carried out. Thus, the solder welding of the lead-out electrodes 34*a* and 34*b* can be carried out under a state where the body of the laminated energy device 18 and the lead-out electrodes 34*a* and 34*b* are both fixed to the module substrate 111.

The lead-out electrodes 34*a* and 34*b* may be bent in advance in a height direction of the module substrate 111 (hereinafter referred to as "substrate height direction"). The substrate height direction corresponds to a vertical direction in FIG. 24 or 25. Thus, since the leading ends 34*t* of the lead-out electrodes 34*a* and 34*b* become closer to the welding holes 25*a* and 25*b* of the solder connections 24*a* and 24*b*, it is possible to carry out the solder welding more simply. A degree of bending may be within a range of several millimeters to several tens millimeters, although it may be appropriately varied depending on thickness, mounting position and so on of the laminated energy device 18.

Figure 26:
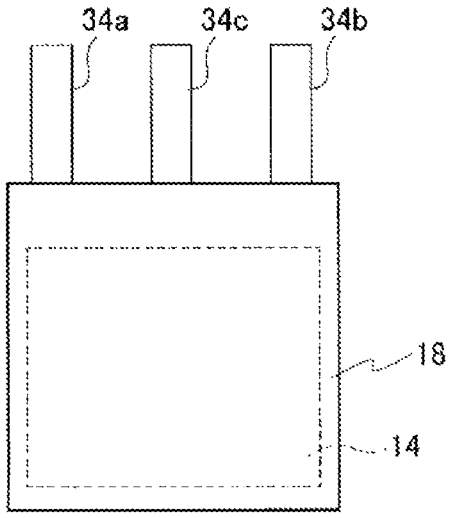
FIG. 26 is a schematic planar pattern configuration view of a three-terminal laminated energy device which may be applied to the LED flash modules according to the first to fourth embodiments.
Figure 27A:
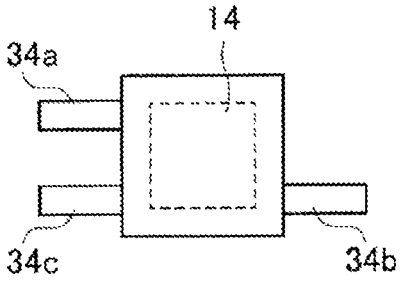
FIGS. 27A to 27F are schematic planar pattern configuration views illustrating variations of the three-terminal laminated energy device which may be applied to the LED flash modules according to the first to fourth embodiments.
Figure 27D:
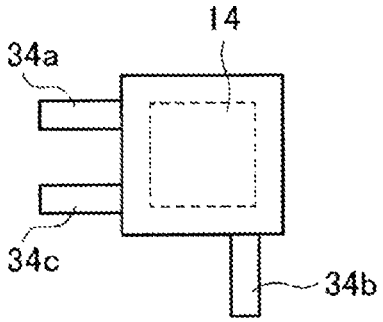
Figure 27B:
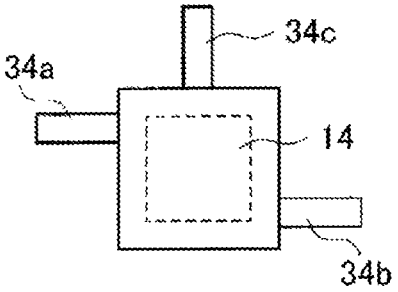
Figure 27E:
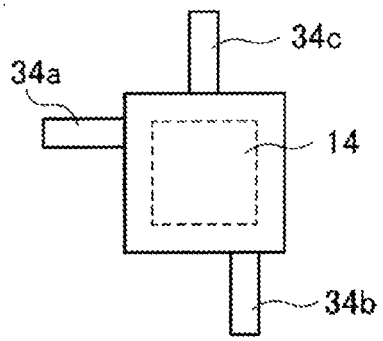
Figure 27C:
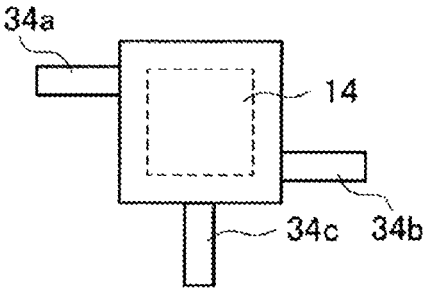
Figure 27F:
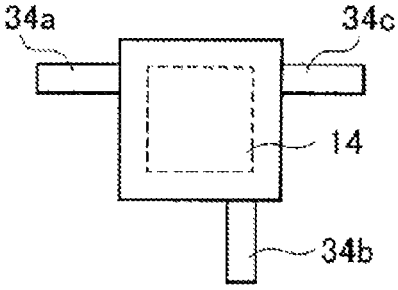
Figure 28A:
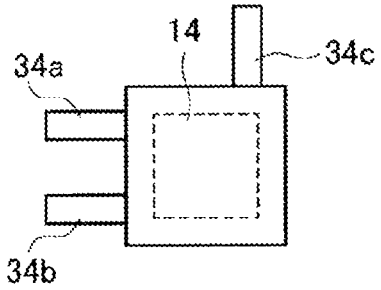
FIGS. 28A to 28F are schematic planar pattern configuration views illustrating variations of the three-terminal laminated energy device which may be applied to the LED flash modules according to the first to fourth embodiments.
Figure 28D:
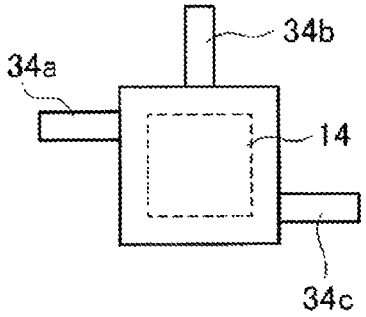
Figure 28B:
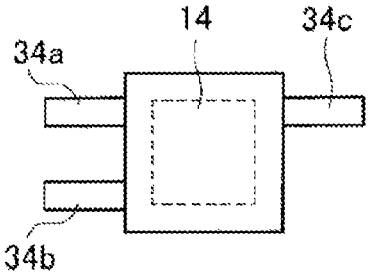
Figure 28E:
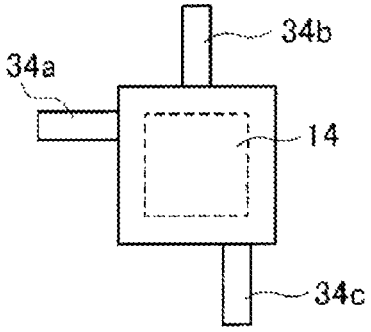
Figure 28C:
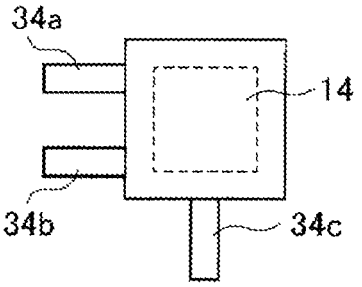
Figure 28F:
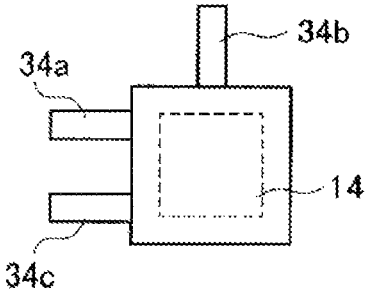

Although the two lead-out electrodes 34*a* and 34*b* are herein illustrated, three lead-out electrodes 34*a*, 34*b* and 34*c* may be provided, as shown in FIG. 26. This three-terminal laminated energy device 18 corresponds to two two-terminal laminated energy devices 18 connected in series. FIGS. 27A to 27F and FIGS. 28A to 28F illustrate variations of arrangement of three lead-out electrodes 34*a*, 34*b* and 34*c* included in the three-electrode laminated energy device 18. As shown in FIGS. 27A to 27F and FIGS. 28A to 28F, the three lead-out electrodes 34*a*, 34*b* and 34*c* can be lead out of any side of the laminated energy device 18. The three-electrode laminated energy device 18 is the same as the two-electrode laminated energy device 18 in that the sealing member 14 is attached to the laminated sheet.

Figure 29:
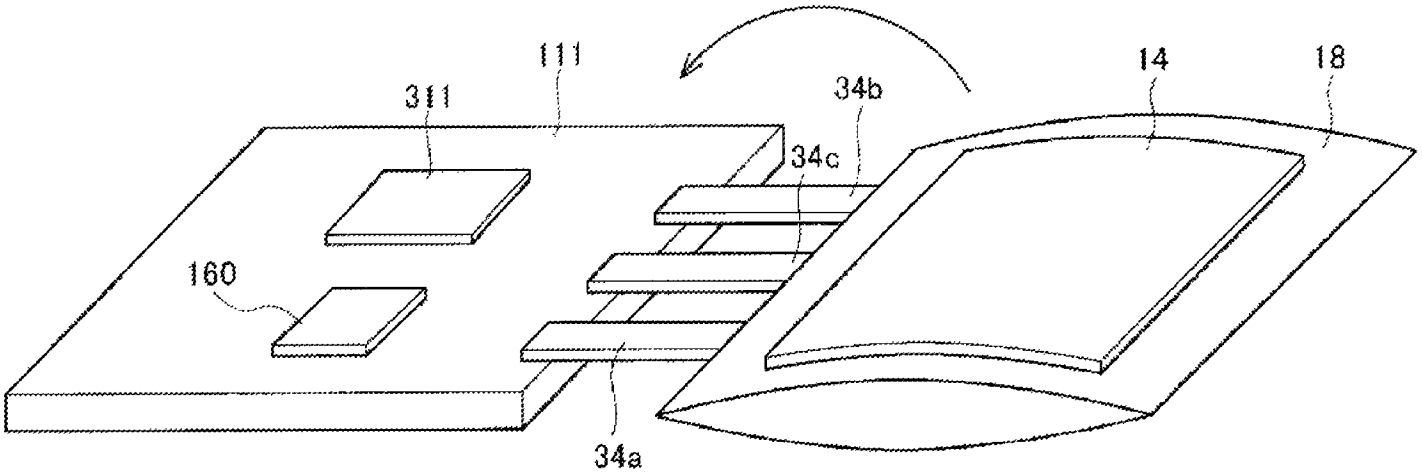
FIG. 29 is a schematic bird's eye structural view for illustrating another method of mounting the laminated energy device which may be applied to the LED flash modules according to the first to fourth embodiments.
Figure 30:
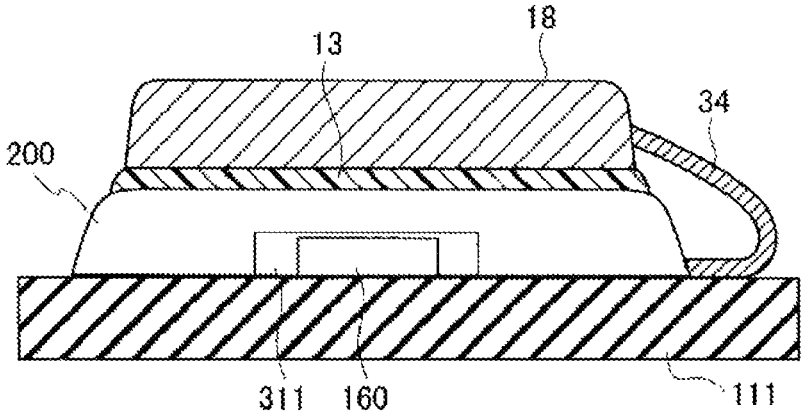
FIG. 30 is a schematic sectional view for illustrating another method of mounting the laminated energy device which may be applied to the LED flash modules according to the first to fourth embodiments.

FIGS. 29 and 30 are views used to illustrate another method of mounting the laminated energy device 18. First, parts such as an EDLC charger circuit 311, a DC/DC converter 160 and so on are mounted on the module substrate 111 and are electrically connected to the module substrate 111 by wire bonding. In addition, the lead-out electrodes 34*a*, 34*b* and 34*c* of the laminated energy device 18 are pressed against and solder-welded to a predetermined position of the module substrate 111. Subsequently, as shown in FIG. 30, parts such as the EDLC charger circuit 311, the DC/DC converter 160 and so on are covered by a hard coat 200. Then, with the release paper 15 of the laminated energy device 18 peeled off, the lead-out electrodes 34*a*, 34*b* and 34*c* are bent and a surface where the sticking agent 13 of the laminated energy device 18 is exposed is attached to an external surface of the hard coat 200. This can provide the module substrate 111 insulated by the hard coat 200 and utilize a limited substrate space in an efficient manner since the laminated energy device 18 is fixed to the hard coat 200.

Figure 31:
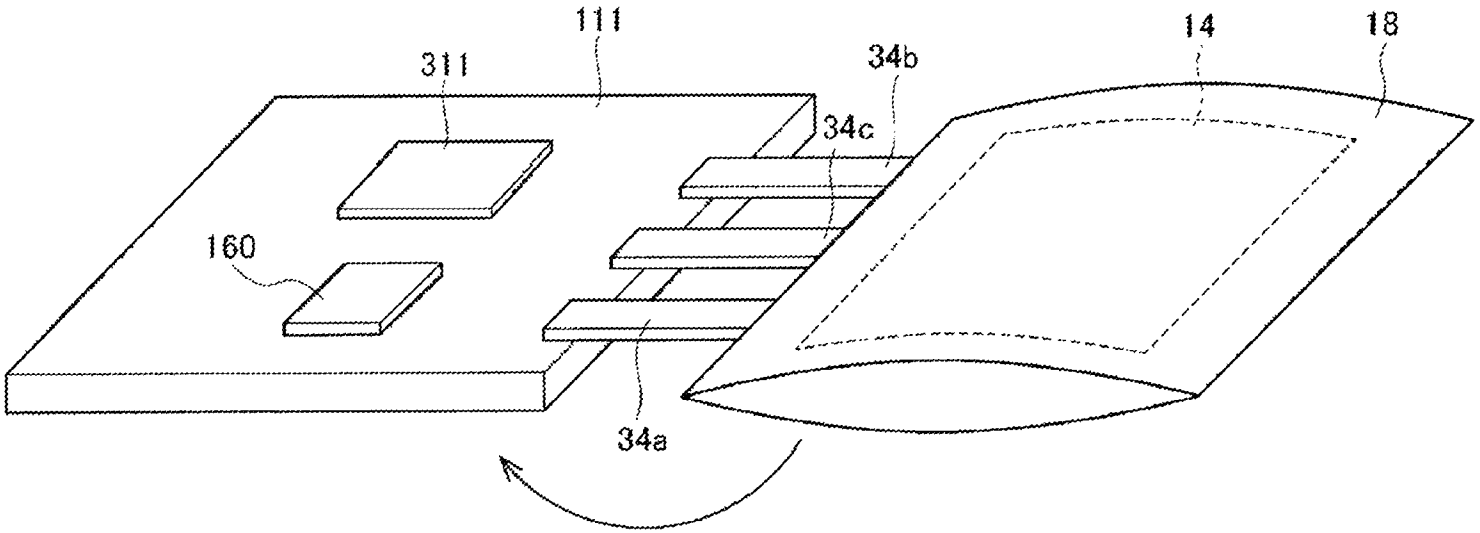
FIG. 31 is a schematic bird's eye structural view for illustrating another method of mounting the laminated energy device which may be applied to the LED flash modules according to the first to fourth embodiments.
Figure 32:
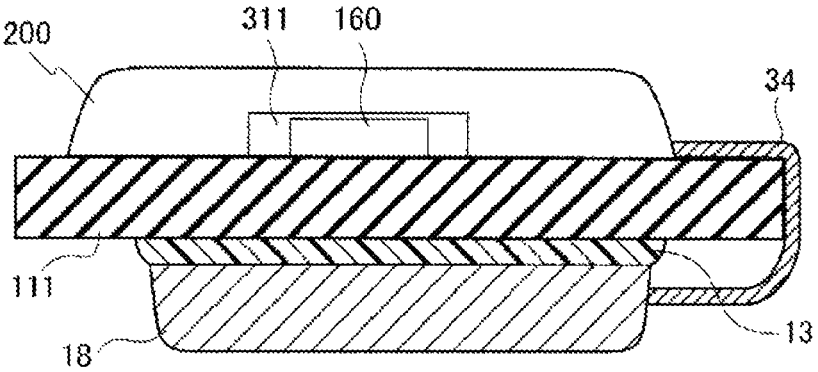
FIG. 32 is a schematic sectional view for illustrating another method of mounting the laminated energy device which may be applied to the LED flash modules according to the first to fourth embodiments.

FIGS. 31 and 32 are views used to illustrate another method of mounting the laminated energy device 18. FIGS. 31 and 32 are the same as FIGS. 29 and 30 except that the lead-out electrodes 34*a*, 34*b* and 34*c* are further extended to fix the laminated energy device 18 to the rear surface of the module substrate 111. That is, as shown in FIG. 31, parts such as an EDLC charger circuit 311, a DC/DC converter 160 and so on are mounted on the module substrate 111 and are electrically connected to the module substrate 111 by wire bonding. In addition, the lead-out electrodes 34*a*, 34*b* and 34*c* of the laminated energy device 18 are pressed against and solder-welded to a predetermined position of the module substrate 111. Subsequently, as shown in FIG. 32, parts such as the EDLC charger circuit 311, the DC/DC converter 160 and so on are covered by a hard coat 200. Then, with the release paper 15 of the laminated energy device 18 peeled off, the lead-out electrodes 34*a*, 34*b* and 34*c* are bent and a surface where the sticking agent 13 of the laminated energy device 18 is exposed is attached to the rear surface of the module substrate 111. As used herein, the phase "the rear surface of the module substrate 111" refers to the opposite surface to a surface on which parts such as the EDLC charger circuit 311, the DC/DC converter 160 and so are mounted. This can provide the module substrate 111 insulated by the hard coat 200 and utilize a limited substrate space in an efficient manner since the laminated energy device 18 is fixed to the rear surface of the module substrate 111.

Although it is herein illustrated that the laminated energy device 18 is bonded to the external surface of the hard coat 200 or the rear surface of the module substrate 111 after the solder welding of the lead-out electrodes 34*a*, 34*b* and 34*c* is carried out, such a mounting procedure is not limited thereto. For example, the solder welding of the lead-out electrodes 34*a*, 34*b* and 34*c* may be carried out after the laminated energy device 18 is bonded to the external surface of the hard coat 200 or the rear surface of the module substrate 111.

As described above, with the laminated energy device 18 which may be applied to the LED flash modules according to the first to fourth embodiments, the laminated energy device 18 can be stably mounted on the module substrate 111 since the laminated energy device 18 is fixed to a mounting position by the sticking agent 13. This can improve reliability of electrical connection and is therefore particularly effective for automated mounting of the laminated energy device 18 and hence mass production of the module substrate 111. In addition, when the laminated energy device 18 is fixed to the external surface of the hard coat 200 or the rear surface of the module substrate 111, it is possible to utilize a limited substrate space in an efficient manner.

Figure 33A:
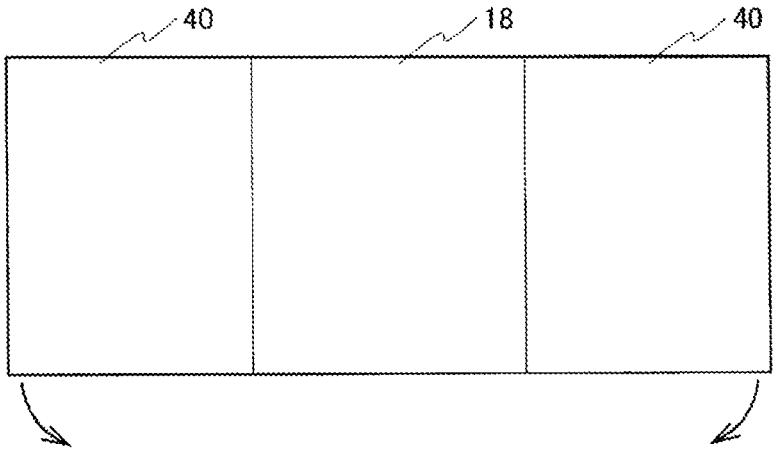
FIG. 33A is a schematic planar pattern configuration view for illustrating a method of mounting the laminated energy device which may be applied to the LED flash modules according to the first to fourth embodiments.
Figure 33B:
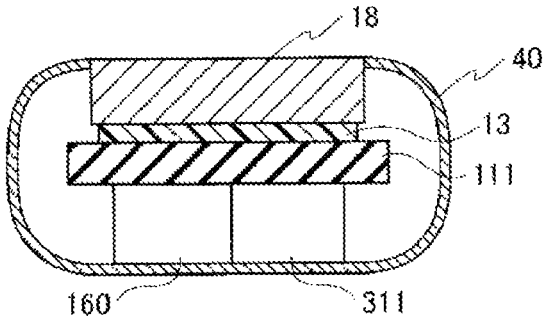
FIG. 33B is a schematic sectional view for illustrating a method of mounting the laminated energy device which may be applied to the LED flash modules according to the first to fourth embodiments, showing a state where the laminated energy device is mounted on a module substrate.

FIGS. 33A and 33B are views used to illustrate a method of mounting the laminated energy device 18 which may be applied to the LED flash modules according to the first to fourth embodiments, FIG. 33A being a schematic planar pattern configuration view and FIG. 33B being a schematic sectional view showing a state where the laminated energy device 18 is mounted on the module substrate 111. As shown in FIGS. 33A and 33B, a laminate sheet 40 is subjected to press processing such that it has a shape to surround the module substrate 111. That is, typically, after the laminate sheet 40 is compressed and sealed along a predetermined laminate line, an unnecessary portion of the laminate sheet 40 is removed by subjecting a line slightly deviated from the laminate line to press processing. In contrast, in this embodiment, as shown in FIG. 33A, press processing is carried out with the laminate sheet 40 left in both sides of the laminated energy device 18. Thus, as shown in FIG. 33B, when the laminated energy device 18 is mounted on the module substrate 111, the module substrate 111 can be enclosed by the laminate sheet 40 provided in both sides of the laminated energy device 18. The module substrate 111 may be enclosed in various ways, as will be described later. In addition, it is sufficient if only the laminated energy device 18 can be fixed to the module substrate 111. The laminate sheet 40 may be made of an insulating film or the like and has preferably high adhesion to the module substrate 111.

Figure 34:
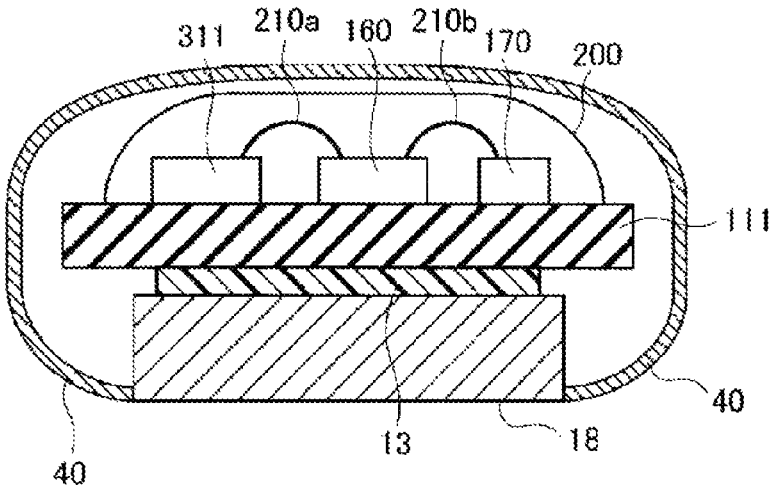
FIG. 34 is a schematic sectional view for illustrating another method of mounting the laminated energy device which may be applied to the LED flash modules according to the first to fourth embodiments.
Figure 35:
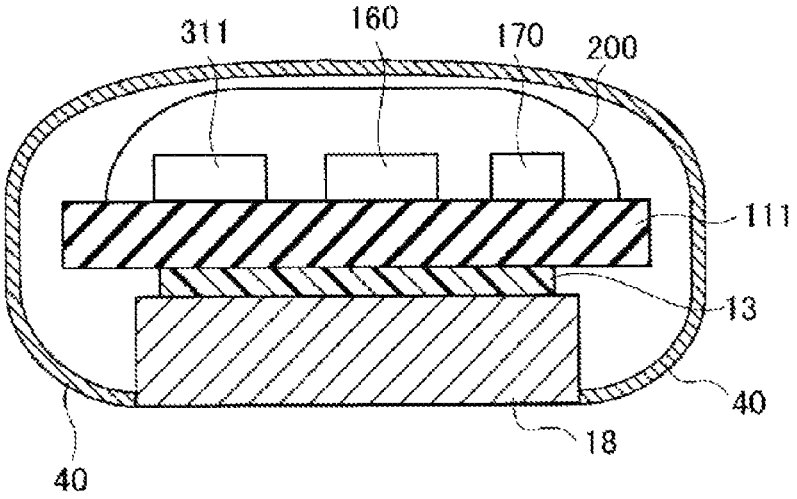
FIG. 35 is a schematic sectional view for illustrating another method of mounting the laminated energy device which may be applied to the LED flash modules according to the first to fourth embodiments.

FIGS. 34 and 35 are views used to illustrate another method of mounting the laminated energy device 18. In FIG. 34, reference numerals 210*a* and 210*b* denote wires interconnecting various parts. As shown in FIGS. 34 and 35, the laminated energy device 18 may be fixed to the rear surface of the module substrate 111 with parts such as the EDLC charger circuit 311, the DC/DC converter 160 and so on covered by the hard coat 200 and the module substrate 111 may be enclosed by the laminate sheet 40 provided in both sides of the laminated energy device 18.

As described above, with the laminated energy device 18 which may be applied to the LED flash modules according to the first to fourth embodiments, the laminated energy device 18 can be stably mounted on the module substrate 111 since the module substrate 111 may be enclosed by the laminate sheet 40. In addition, enclosure of parts such as the EDLC charger circuit 311, the DC/DC converter 160 and so on by the laminate sheet 40 can provide advantages of stable mounting of the parts and protection against unnecessary electrical connection.

Although it is illustrated in this embodiment that the laminated energy device 18 is fixed to the module substrate 111 by the sticking agent 13, whether or not the sticking agent 13 is used is not particularly limited. That is, a certain effect can be anticipated in that the laminated energy device 18 is fixed to the module substrate 111 just by enclosing the module substrate 111 by the laminate sheet 40.

Figure 36A:
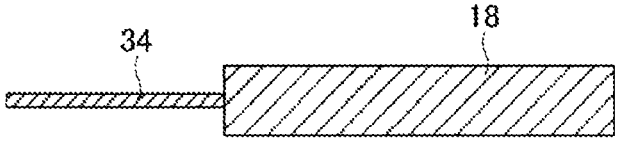
FIG. 36A is a schematic sectional view for illustrating variations of a bending process of a lead-out electrode in the laminated energy device which may be applied to the LED flash modules according to the first to fourth embodiments, showing a case where no bending process is carried out.
Figure 36B:
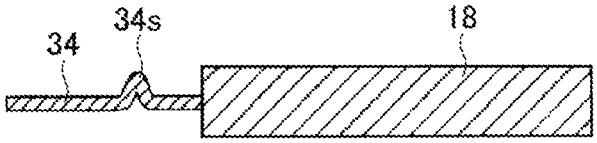
FIG. 36B is a schematic sectional view for illustrating variations of a bending process of a lead-out electrode in the laminated energy device which may be applied to the LED flash modules according to the first to fourth embodiments, showing a case where a bending process is carried out.
Figure 36C:
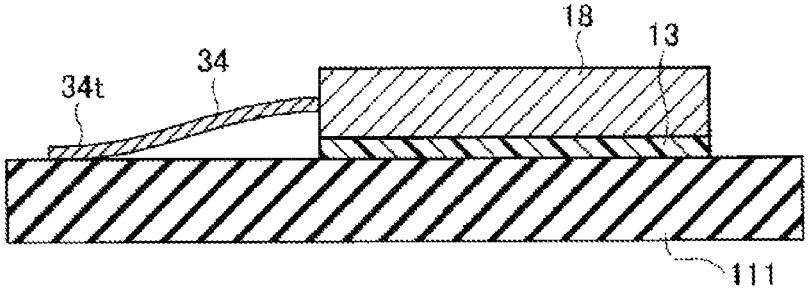
FIG. 36C is a schematic sectional view for illustrating variations of a bending process of a lead-out electrode in the laminated energy device which may be applied to the LED flash modules according to the first to fourth embodiments, showing a case where no bending process is carried out.
Figure 36D:
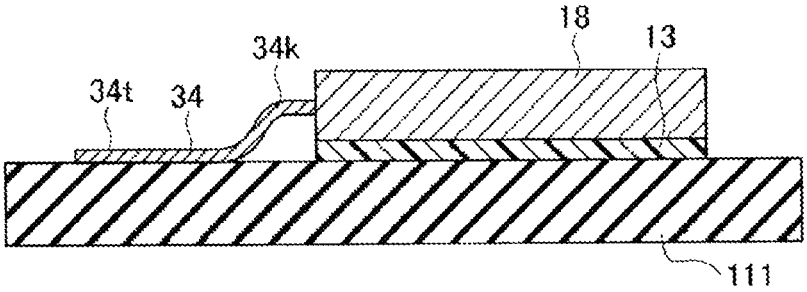
FIG. 36D is a schematic sectional view for illustrating variations of a bending process of a lead-out electrode in the laminated energy device which may be applied to the LED flash modules according to the first to fourth embodiments, showing a case where a bending process is carried out.

FIGS. 36A to 36D are views used to illustrate variations of a bending process of the lead-out electrode 34 in the laminated energy device 18 which may be applied to the LED flash modules according to the first to fourth embodiments. FIG. 36A shows a case where no bending process is carried out and FIG. 36B shows a case where a "^"-shaped bending portion 34*s* is provided in a middle portion of the lead-out electrode 34. The "^"-shaped bending portion 34*s* allows the lead-out electrode 34 to absorb a stress caused by any load applied thereto. FIG. 36C shows a case where the lead-out electrode 34 is smoothly inclined in a left side of FIG. 36C without being subjected to any bending process and FIG. 36D shows a case where the lead-out electrode 34 is provided with a bending portion 34*k* and thus sharply inclined in the left side of FIG. 36D. While the height of a leading end 34*t* of the lead-out electrode 34 may be adjusted by either FIG. 36C or FIG. 36D, FIG. 36D allows the leading end 34*t* of the lead-out electrode 34 to be closer to the laminated energy device 18 than FIG. 36C.

Figure 37A:
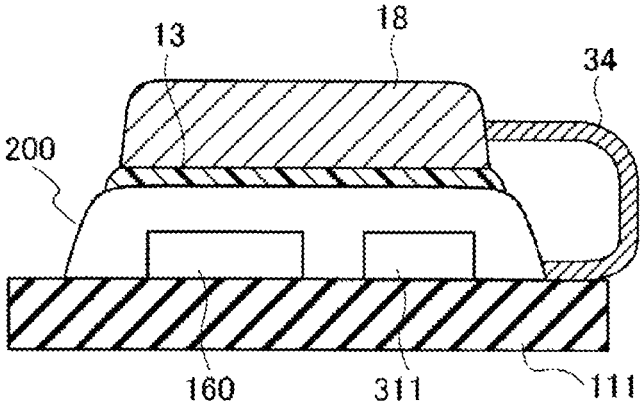
FIG. 37A is a schematic sectional view for illustrating another method of mounting the laminated energy device which may be applied to the LED flash modules according to the first to fourth embodiments, in which a lead-out electrode is folded in such a manner that a surface where a sticking agent of an EDLC (Electric Double Layer Capacitor) is exposed is bonded to an external surface of a hard coat.
Figure 37B:
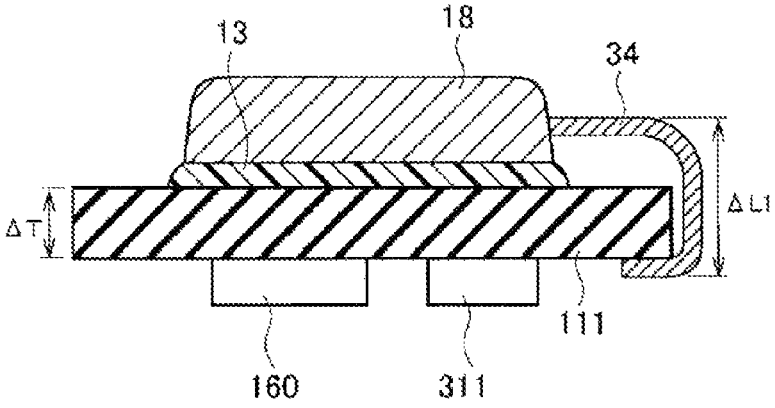
FIG. 37B is a schematic sectional view for illustrating another method of mounting the laminated energy device which may be applied to the LED flash modules according to the first to fourth embodiments, in which a lead-out electrode is folded in such a manner that a surface where a sticking agent of the EDLC is exposed is bonded to an opposite surface to a substrate surface.

FIGS. 37A and 37B are views used to illustrate another method of mounting the laminated energy device 18 which may be applied to the LED flash modules according to the first to fourth embodiments. In FIG. 37A, the lead-out electrode 34 is folded in such a manner that a surface where the sticking agent 13 of the laminated energy device 18 is exposed is bonded to the external surface of the hard coat 200. In FIG. 37B, the lead-out electrode 34 is folded in such a manner that a surface where the sticking agent 13 of the laminated energy device 18 is exposed is bonded to an opposite surface to a substrate surface where parts such as the EDLC charger circuit 311, the DC/DC converter 160 and so on are mounted. In other words, the lead-out electrode 34 covers only the opposite surface to the substrate surface on which the laminated energy device 18 is mounted. On that purpose, in this case, the length Δf the lead-out electrode 34 in the substrate height direction is set to be longer than the height Δthe module substrate 111.

Figure 38A:
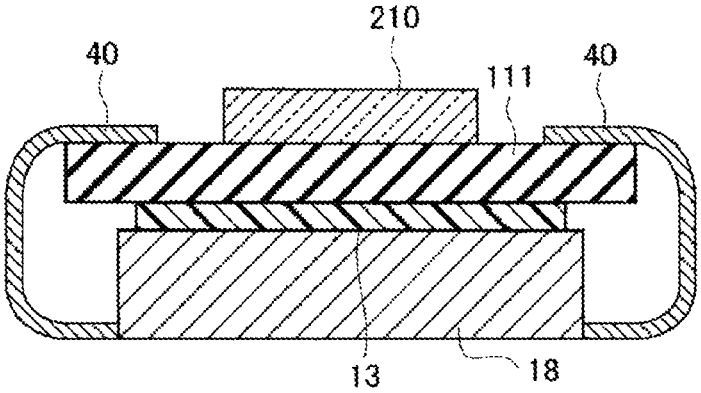
FIG. 38A is a schematic sectional view for illustrating another method of mounting the laminated energy device which may be applied to the LED flash modules according to the first to fourth embodiments, in which the EDLC is fixed to a rear surface of the module substrate.
Figure 38B:
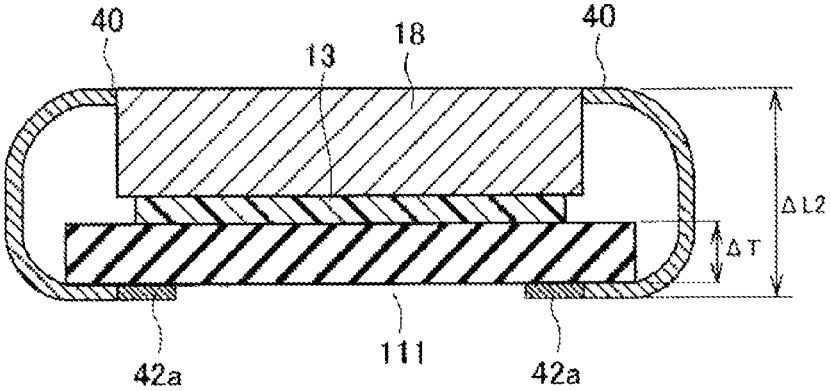
FIG. 38B is a schematic sectional view for illustrating another method of mounting the laminated energy device which may be applied to the LED flash modules according to the first to fourth embodiments, in which an end of a laminate sheet makes contact with or cover a particular part.

FIGS. 38A and 38B are views used to illustrate another method of mounting the laminated energy device 18 which may be applied to the LED flash modules according to the first to fourth embodiments. In FIG. 38A, the laminated energy device 18 is fixed to the rear surface of the module substrate 111 and only the opposite surface to the substrate surface on which the laminated energy device 18 is mounted is covered by the laminate sheet 40 provided in both sides of the laminated energy device 18. This configuration is particularly effective when a part 210 is an LED. That is, the module substrate 111 can be enclosed by the laminate sheet 40 without blocking light from the LED 210. Although the laminate sheet 40 may cover just the substrate surface, an end of the laminate sheet 40 may make contact with or cover a particular part 42*E*in this case, the length Δf the laminate sheet 40 is set to be longer than the height ΔT of the module substrate 111, as shown in FIG. 38B.

Figure 39:
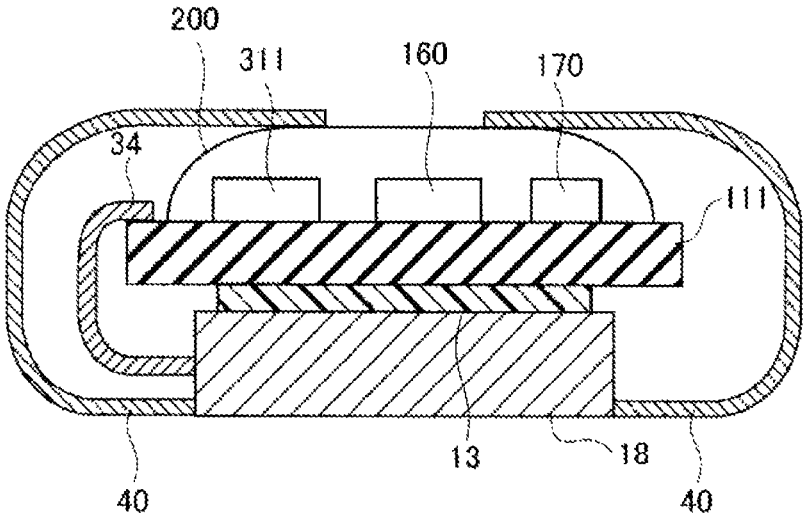
FIG. 39 is a schematic sectional view for illustrating another method of mounting the laminated energy device, which may be applied to the LED flash modules according to the first to fourth embodiments.

FIG. 39 is a view used to illustrate another method of mounting the laminated energy device 18 which may be applied to the LED flash modules according to the first to fourth embodiments. In FIG. 39, the laminated energy device 18 is fixed to the module substrate 111 by both of the lead-out electrode 34 and the laminate sheet 40. An end of the laminate sheet 40 covers the external surface of the hard coat 200. In this manner, various mounting methods may be combined where appropriate.

Although the EDLC has been illustrated as the laminated energy device 18 in the above description, a lithium ion capacitor or a lithium ion battery may be employed as the laminated energy device 18. A basic structure of each internal electrode will now be described.

(EDLC Internal Electrode)

Figure 40:
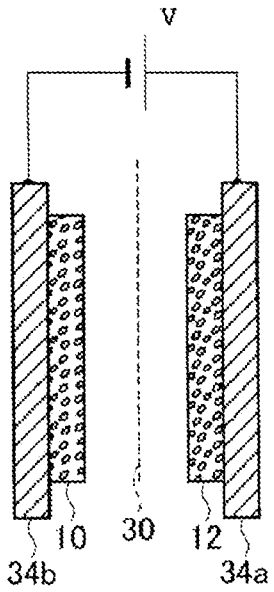
FIG. 40 is a schematic planar pattern configuration view illustrating a basic structure of an EDLC internal electrode in the laminated energy device, which may be applied to the LED flash modules according to the first to fourth embodiments.

FIG. 40 shows a basic structure of an EDLC internal electrode in the laminated energy device 18 which may be applied to the LED flash modules according to the first to fourth embodiments. The EDLC internal electrode includes at least one layer of active material electrodes 10 and 12, a separator 30 which is interposed between the active material electrodes 10 and 12 and passes only electrolytes and ions, and lead-out electrodes 34*a* and 34*b* which are exposed from the active material electrodes 10 and 12 and are connected to a power source V. The lead-out electrodes 34*a* and 34*b* are made of, for example, an aluminum foil and the active material electrodes 10 and 12 are made of, for example, activated carbon. The separator 30 is larger (i.e., has a wider area) than the active material electrodes 10 and 12 so that it can cover the entire surface of the active material electrodes 10 and 12. The separator 30 requires heat resistance if it particularly needs to cope with reflow, although it has no principle dependency on the kind of energy device. The separator 30 may be made of polypropylene or the like if it requires no heat resistance. The separator 30 may be made of cellulose or the like if it requires any heat resistance. The EDLC internal electrode is impregnated with electrolytes and the electrolytes and ions are migrated at the time of charging/discharging through the separator 30.

(Lithium Ion Capacitor Internal Electrode)

Figure 41:
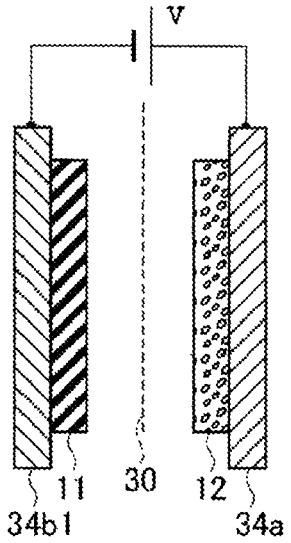
FIG. 41 is a schematic planar pattern configuration view illustrating a basic structure of a lithium ion capacitor internal electrode in the laminated energy device, which may be applied to the LED flash modules according to the first to fourth embodiments.

FIG. 41 shows a basic structure of a lithium ion capacitor internal electrode in the laminated energy device 18 which may be applied to the LED flash modules according to the first to fourth embodiments. The lithium ion capacitor internal electrode includes at least one layer of active material electrodes 11 and 12, a separator 30 which is interposed between the active material electrodes 11 and 12 and passes only electrolytes and ions, and lead-out electrodes 34*a* and 34*w*h are exposed from the active material electrodes 11 and 12 and are connected to a power source V. The positive active material electrode 12 is made of, for example, activated carbon and the negative active material electrode 11 is made of, for example, Li-doped carbon. The positive lead-out electrode 34*a* is made of, for example, an aluminum foil and the negative lead-out electrode 34*i*is made of, for example, a copper foil. The separator 30 is larger (i.e., has a wider area) than the active material electrodes 11 and 12 so that it can cover the entire surface of the active material electrodes 11 and 12. The lithium ion capacitor internal electrode is impregnated with electrolytes and the electrolytes and ions are migrated at the time of charging/discharging through the separator 30.

(Lithium Ion Battery Internal Electrode)

Figure 42:
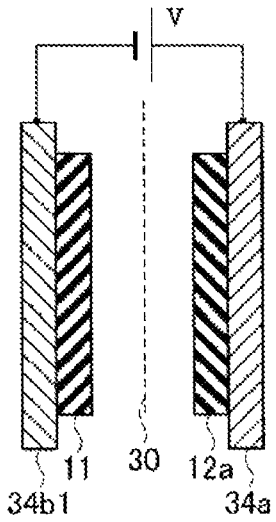
FIG. 42 is a schematic planar pattern configuration view illustrating a basic structure of a lithium ion battery internal electrode in the laminated energy device, which may be applied to the LED flash modules according to the first to fourth embodiments.
Figure 43:
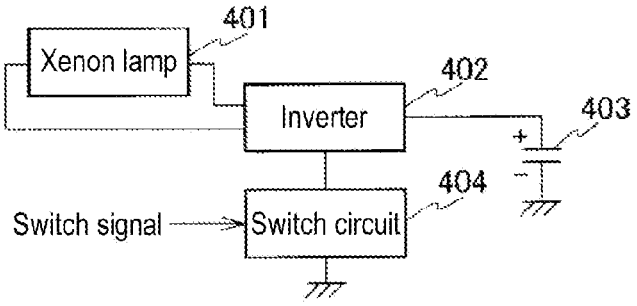
FIG. 43 is a schematic block diagram of a conventional flash device.

FIG. 42 shows a basic structure of a lithium ion battery internal electrode in the laminated energy device 18 which may be applied to the LED flash modules according to the first to fourth embodiments. The lithium ion capacitor internal electrode according to this embodiment includes at least one layer of active material electrodes 11 and 12*a*, a separator 30 which is interposed between the active material electrodes 11 and 12*a* and passes only electrolytes and ions, and lead-out electrodes 34*a* and 34*b*1 which are exposed from the active material electrodes 11 and 12*a* and are connected to a power source V. The positive active material electrode 12*a* is made of, for example, $LiCoO_2$ and the negative active material electrode 11 is made of, for example, Li-doped carbon. The positive lead-out electrode 34*a* is made of, for example, an aluminum foil and the negative lead-out electrode 34*b*1 is made of, for example, a copper foil. The separator 30 is larger (i.e., has a wider area) than the active material electrodes 11 and 12*a* so that it can cover the entire surface of the active material electrodes 11 and 12*a*. The lithium ion battery internal electrode is impregnated with electrolytes and the electrolytes and ions are migrated at the time of charging/discharging through the separator 30.

As described above, the embodiments of the present disclosure can provide an LED flash module, an LED module and an imaging device, which are capable of reducing time required for charging with a low voltage operation and achieving compactness and lightness.

Other Embodiments

Although the present disclosure has been described in the above by ways of the first to fourth embodiments, it is to be understood that the description and drawings constituting parts of the present disclosure are merely illustrative but not limitative. Various alternative embodiments, examples and operation techniques will be apparent to those skilled in the art when reading from the above description and the drawings.

Thus, the present disclosure is intended to encompass different embodiments which are not described herein.

The LED flash modules and the LED modules of the present disclosure may be applied to flash devices which can be applied to imaging devices such as digital cameras, monitoring cameras and so on. Further, the LED flash modules and the LED modules of the present disclosure may be applied to products equipped with a plurality LED devices such as LED lamps and so on.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. An LED flash module comprising:

a module substrate;

an energy device disposed on the module substrate and configured to have a laminated body of two or more layers including positive and negative active material electrodes and positive and negative lead-out electrodes, which are integrally formed, and a separator interposed between the positive and negative active material electrodes and configured to pass electrolytes and ions, the two or more layers being laminated such that the lead-out electrodes are exposed from the positive and negative active material electrodes and the active positive and negative material electrodes are alternated;

an LED module arranged on the module substrate and including a plurality of LED blocks arranged in a first direction, each LED block including a plurality of LED elements which are arranged in a second direction perpendicular to the first direction and configured to emit light via power supplied from the energy device;

a charger circuit arranged on the module substrate and charges the energy device; and a control circuit arranged on the module substrate and controls emission of the LED elements, wherein a plus terminal and a minus terminal of a power supply portion supplying power to the LED elements are coupled to the LED elements via a first wire and a second wire, respectively, and wherein a sum of lengths of the first and second wires is substantially the same for all of the LED elements.

2. The LED flash module of claim 1, wherein the LED module includes a first comb-like wiring pattern and a second comb-like wiring pattern disposed in an interdigital relationship with each other and the LED elements being mounted on the first comb-like wiring pattern and being wire-bonded to the second comb-like wiring pattern.

3. The LED flash module of claim 1, wherein the LED module includes a first comb-like wiring pattern and a second comb-like wiring pattern disposed in an interdigital relationship with each other and each of the LED blocks configured to have a floating island wiring pattern on which the LED elements are mounted, and the LED elements are wire-bonded to the first and second comb-like wiring patterns.

4. The LED flash module of claim 1, wherein the LED module is mounted on a front surface of the module substrate and the charger circuit and the control circuit are mounted on a rear surface of the module substrate.

5. The LED flash module of claim 1, wherein the control circuit selectively lights on desired ones of the plurality of LED elements.

6. The LED flash module of claim 1, wherein a white resin dam is coated in the form of a figure "8" shape around the LED elements such that the white resin dam has a closed area for respective LED block and a fluorescent layer is coated in the figure "8"-shaped white resin dam.

7. The LED flash module of claim 1, wherein a white resin dam is coated in the form of a rectangle around the LED elements, and dams acting as partitions are coated in the rectangular white resin dam in such a manner that they define a closed area for respective LED block, and a fluorescent layer is coated in each closed area partitioned by the dams.

8. The LED flash module of claim 1, wherein a white resin dam is coated in the form of a rectangle around the LED elements such that the white resin dam has a closed area for respective unit of LED block, and a fluorescent layer is coated in the rectangular white resin dam.

9. The LED flash module of claim 1, wherein the energy device is an electric double layer capacitor.

10. The LED flash module of claim 1, wherein the energy device is a lithium ion capacitor.

11. The LED flash module of claim 1, wherein the energy device is a lithium ion battery.

12. An LED flash module comprising:

a module substrate;

an energy device disposed on the module substrate and configured to have a laminated body of two or more layers including positive and negative active material electrodes and positive and negative lead-out electrodes, which are integrally formed, and a separator interposed between the positive and negative active material electrodes and configured to pass electrolytes and ions, the two or more layers being laminated such that the lead-out electrodes are exposed from the active positive and negative material electrodes and the active positive and negative material electrodes are alternated;

an LED module arranged on the module substrate and includes a plurality of LED blocks arranged in a first direction, each LED block including a plurality of LED elements arranged in a second direction perpendicular to the first direction and configured to emit light with power supplied from the energy device;

a charger circuit arranged on the module substrate and charges the energy device; and a control circuit arranged on the module substrate and controls emission of the LED elements, wherein color rendition of the LED blocks is variable.

13. The LED flash module of claim 12, wherein the control circuit is configured to drive the LED blocks individually and control at least one of a value of current flowing into each of the LED blocks and lighting time.

14. The LED flash module of claim 12, wherein a white resin dam is coated around the LED elements and fluorescent layers having different color renditions are coated around a region surrounded by the white resin dam.

15. An LED module including a plurality of LED blocks arranged in a first direction, each LED block including a plurality of LED elements arranged in a second direction perpendicular to the first direction, wherein a plus terminal and a minus terminal of a power supply portion supplying power to the LED elements are coupled to the LED elements via a first wire and a second wire, respectively, and wherein a sum of lengths of the first and second wires is substantially the same for all of the LED elements.

16. The LED module of claim 15, wherein the LED module includes a first comb-like wiring pattern and a second comb-like wiring pattern which are disposed in an interdigital relationship with each other and the LED elements are mounted on the first comb-like wiring pattern and are wire-bonded to the second comb-like wiring pattern.

17. The LED module of claim 15, wherein the LED module includes a first comb-like wiring pattern and a second comb-like wiring pattern which are disposed in an interdigital relationship with each other and each of the LED blocks has a floating island wiring pattern on which the LED elements are mounted, and the LED elements are wire-bonded to the first and second comb-like wiring patterns.

18. The LED module of claim 15, wherein a white resin dam is coated in the form of a figure '8' shape around the LED elements such that the white resin dam has a closed area for respective LED block and a fluorescent layer is coated in the figure '8'-shaped white resin dam.

19. The LED module of claim 15, wherein a white resin dam is coated in the form of a rectangle around the LED elements, and dams acting as partitions are coated in the rectangular white resin dam in such a manner that they define a closed area for respective LED block, and a fluorescent layer is coated in each closed area partitioned by the dams.

20. The LED module of claim 15, wherein a white resin dam is coated in the form of a rectangle around the LED elements such that the white resin dam has a closed area for respective LED block, and a fluorescent layer is coated in the rectangular white resin dam.

21. An LED module including a plurality of LED blocks arranged in a first direction, each LED block including a plurality of LED elements which are arranged in a second direction perpendicular to the first direction, wherein color rendition of the LED blocks is variable.

22. The LED module of claim 21, wherein a white resin dam is coated around the LED elements and fluorescent layers having different color renditions are coated around a region surrounded by the white resin dam.

23. An imaging device comprising the LED flash module of claim 12.

24. An imaging device comprising the LED flash module of claim 1.

* * * * *